US008678385B2

(12) United States Patent
Hayashi et al.

(10) Patent No.: US 8,678,385 B2
(45) Date of Patent: Mar. 25, 2014

(54) SHEET CONVEYING DEVICE

(71) Applicants: Kohei Hayashi, Okazaki (JP); Shigeo Tomita, Toyokawa (JP)

(72) Inventors: Kohei Hayashi, Okazaki (JP); Shigeo Tomita, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/646,334

(22) Filed: Oct. 5, 2012

(65) Prior Publication Data

US 2013/0087969 A1 Apr. 11, 2013

(30) Foreign Application Priority Data

Oct. 5, 2011 (JP) ..... 2011-220948

(51) Int. Cl.
*B65H 7/02* (2006.01)
*B65H 5/00* (2006.01)

(52) U.S. Cl.
USPC ..... 271/265.01; 271/264

(58) Field of Classification Search
USPC ..... 271/264, 265.01, 265.02, 256, 258.01, 271/259
See application file for complete search history.

(56) References Cited

U.S. PATENT DOCUMENTS

| | | | | |
|---|---|---|---|---|
| 7,802,783 | B2 | 9/2010 | Matsushima | |
| 2008/0106030 | A1* | 5/2008 | Takenaka | 271/259 |
| 2008/0136094 | A1* | 6/2008 | Elliot | 271/270 |
| 2009/0189339 | A1* | 7/2009 | Ohishi et al. | 271/259 |
| 2010/0163366 | A1* | 7/2010 | Jenrick et al. | 194/206 |
| 2011/0241289 | A1* | 10/2011 | Yamamoto et al. | 271/264 |
| 2012/0139180 | A1* | 6/2012 | Ohshima et al. | 271/258.01 |
| 2013/0161900 | A1* | 6/2013 | Takahashi et al. | 271/228 |

FOREIGN PATENT DOCUMENTS

| | | |
|---|---|---|
| JP | 62-93156 | 4/1987 |
| JP | 11-343064 | 12/1999 |
| JP | 2008-74533 | 4/2008 |

* cited by examiner

*Primary Examiner* — Patrick Cicchino
(74) *Attorney, Agent, or Firm* — Morrison & Foerster LLP

(57) ABSTRACT

A sheet positional information updating unit of a sheet conveying device updates positional information on a leading end of a sheet by adding a sheet feed amount of a second-stage vertically conveying roller. The sheet positional information updating unit stops the update of the positional information when a first-stage vertically conveyance sensor does not detect the leading end of the sheet in the case that the positional information on the leading end of the sheet arrives at a position on an upstream side of a leading-end detection position of the first-stage vertically conveyance sensor. The sheet positional information updating unit resumes the update of the positional information on the leading end of the sheet in the case that first-stage vertically conveyance sensor detects the leading end of the sheet.

13 Claims, 17 Drawing Sheets

SHEET CONVEYING DEVICE

This application is based on Japanese Patent Application No. 2011-220948 filed with the Japan Patent Office on Oct. 5, 2011, the entire content of which is hereby incorporated by reference.

BACKGROUND OF THE INVENTION

1. Field of the Invention

The present invention relates to a sheet conveying device, more particularly to a sheet conveying device that conveys a sheet in an image forming apparatus, such as a printer and an MFP (Multifunction Peripheral).

2. Description of the Related Art

Examples of an electrophotographic image forming apparatus include the MFP having a scanner function, a facsimile function, a copying function, a function as a printer, a data communication function, and a server function, a facsimile machine, a copying machine, and the printer.

For example, an image is formed on a sheet by the following method in a general image forming process in which an electrophotographic system is adopted. A toner image is formed on a surface of an image bearing member by an electrostatic recording method, and the toner image is transferred to an intermediate transfer belt by a primary transfer roller, and conveyed to a secondary transfer roller. The sheet is fed from a feed cassette one by one, and conveyed to the secondary transfer roller in at a predetermined time. The toner image on the intermediate transfer body is electrostatically transferred to the sheet conveyed to the secondary transfer roller. Then the sheet is conveyed to a fixing device. Heat and a pressure are applied to the sheet by the fixing device, thereby fixing the toner image. The sheet to which the toner image is fixed is discharged to a catch tray by a sheet conveying device.

The sheet conveying device includes a plurality of rollers (conveying rollers) disposed along a sheet passage route. The conventional sheet conveying device performs conveyance sequence control. That is, positional information on a position of the sheet conveyed along the sheet passage route is calculated from a sheet feed amount (the number of revolutions of a roller) by each roller, and the rollers are sequentially driven or stopped based on the positional information on the sheet. For example, the sheet conveying device starts the drive of the downstream-side roller when detecting that a leading end of the sheet arrives at the roller on the downstream side of the sheet passage route from the positional information on the sheet. The sheet conveying device stops the drive of the upstream-side roller when detecting that a tailing end of the sheet passes by the roller on the upstream side of the sheet passage route from the positional information on the sheet.

However, conventionally the positional information on the sheet is calculated based only on the sheet feed amount by the roller. Therefore, in the case that the sheet slips on the roller, only the positional information on the sheet is updated, and a deviation is generated between the actual position of the sheet and the positional information on the sheet. Although the leading end of the sheet does not actually arrive at the downstream-side roller, the downstream-side roller is driven while the upstream-side roller is stopped, and a conveyance mistake is generated between the upstream-side roller and the downstream-side roller, which results in a jam.

Conventionally, in order to prevent the generation of the jam due to the deviation between the actual position of the sheet and the positional information on the sheet, a sensor (conveyance sensor) that detects the arrival of the sheet is disposed at a point (a point at which a transfer of the drive is generated between the conveying rollers) at which drive states of the upstream-side roller and the downstream-side roller are switched in the sheet passage route. The sheet conveying device switches the drive states of each roller based on the detection state of the sensor in addition to the positional information on the sheet. Specifically, when the sensor provided near the downstream-side roller detects the leading end of the sheet, the sheet conveying device starts the drive of the downstream-side roller, and the downstream-side roller starts to convey the sheet.

A conveyance control program in a section as described above including the point at which the drive states of the upstream-side roller and the downstream-side roller are switched includes a sheet position management module that calculates, updates and retains the positional information on the sheet and a sequence module that refers to the positional information on the sheet to sequentially drive each rollers. The sequence module includes a sheet feeding sequence module at each sheet feeding port, which feeds the sheet from a feed cassette to convey the sheet to a downstream-side vertically conveying roller of the sheet feeding roller, and a vertically conveying sequence module that conveys the sheet from an upstream-side vertically conveying roller to a downstream-side vertically conveying roller as a sub-module according to a sheet conveying section.

For example, Documents 1 and 2 disclose technologies related to the sheet conveyance. Document 1 discloses the technology, in which a plurality of switches are included to detect the sheet and a paper location is updated based on the sheet detection states of the switches. In the technology disclosed in Document 2, a progression permitting unit calculates the time the next sheet is fed from a sheet size and a conveying path length and informs a transfer sheet unit of the sheet feeding time, and the transfer sheet unit receives a message from the progression permitting unit to control movement and stop of a print sheet.

Document 1: Japanese Patent Publication Laying-Open No. 62-93156

Document 2: Japanese Patent Publication Laying-Open No. 11-343064

In the case that a developer who develops each module of the sheet conveying device develops a plurality of models, it is necessary to design a position in which the drive of the roller is started in each model in order to prevent the conveyance mistake. It is necessary that each module refer to not only the positional information on the sheet but also the detection state of the sensor at the point at which the drive states of the upstream-side roller and the downstream-side roller are switched. As a result, unfortunately a device configuration becomes complicated. The problem cannot be solved in Documents 1 and 2.

The detection state of the sensor depends on the position in which the sensor is disposed and the number of sensors. Because the plurality of points at each of which the drive states of the upstream-side roller and the downstream-side roller are switched exist in one model, it is necessary for the developer to change a setting based on the detection state of the sensor at each point, and the developer takes a lot of trouble with production of the module. Because the position in which the sensor is disposed and the number of sensors vary in each model, the developer further takes a lot of trouble with the production of the module in the case that the plural models are developed.

As described above, the conventional sheet conveying device is designed depending on the detection state of the sensor that is changed in each model of the image forming apparatus. Therefore, the sheet conveying device is designed to be specialized only in a specific model, the design depending on the sensor state obstructs the development of the sheet conveying device (the sequence module) common to plural models to reduce development efficiency.

SUMMARY OF THE INVENTION

An object of the present invention is to provide a sheet conveying device that can promote commonality of the sequence module in a plurality of models.

Another object of the present invention is to provide a sheet conveying device in which the device configuration can be simplified.

In accordance with one aspect of the present invention, a sheet conveying device includes: a first conveying roller for conveying a sheet; a second conveying roller for conveying the sheet on a downstream side of the first conveying roller; a detection sensor for detecting a leading end of the sheet in a leading-end detection position on the downstream side of the second conveying roller; a first leading-end position output unit for outputting positional information on the leading end of the sheet; and a controller for controlling drive states of the first and second conveying rollers respectively, based on not a detection state of the detection sensor but the positional information on the leading end of the sheet, which is outputted from the first leading-end position output unit, wherein the first leading-end position output unit includes: a first leading-end position updating unit for updating the positional information on the leading end of the sheet by adding a feed amount of the sheet conveyed by the first conveying roller; a leading-end position update stopping unit for stopping the update of the positional information on the leading end of the sheet, which is performed by the first leading-end position updating unit, when the detection sensor does not detect the leading end of the sheet in the case that the positional information updated by the first leading-end position updating unit arrives at a position on an upstream side of the leading-end detection position; and a first leading-end position update resuming unit for resuming the update of the positional information on the leading end of the sheet, which is performed by the first leading-end position updating unit, with the leading-end detection position as a starting point in the case that the detection sensor detects the leading end of the sheet after the leading-end position update stopping unit stops the update.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, embodiments of the present invention will be described with reference to the drawings.

In the following embodiments, by way of example, the sheet conveying device is the image forming apparatus, particularly the MFP. For example, in the image forming apparatus, the image is formed by the electrophotographic system or the electrostatic recording system. In addition to the MFP, the image forming apparatus may be a facsimile machine, copying machines, such as a PPC (Plain Paper Copier), or printers, such as a laser printer. The image forming apparatus may form either a monochrome image or a color image. In the image forming apparatus, the image may be formed by either an analog system or a digital system. The sheet conveying device can convey the sheet, and the sheet conveying device may be an apparatus except the image forming apparatus.

First Embodiment

Figure 1:
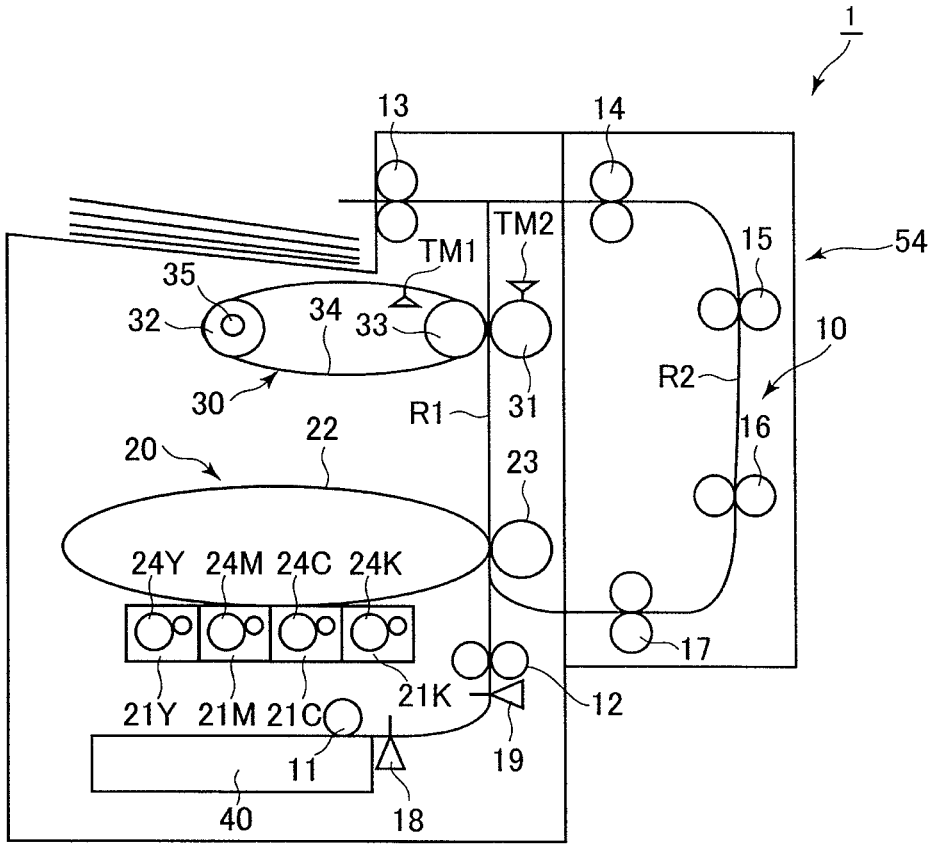
FIG. 1 is a sectional view schematically illustrating a configuration of a print engine unit of an MFP1 according to a first embodiment of the present invention.

Referring to FIG. 1, a tandem type MFP1 that is an image forming apparatus of a first embodiment mainly includes a scanner 52 (FIG. 2) and a print engine unit 54 that performs printing to a sheet (image formation).

Print engine unit 54 has a color print function, and includes a sheet conveying unit 10 (an example of the sheet conveying device), a transfer unit 20, and a fixing unit 30. As needed basis, print engine unit 54 combines four color images of yellow (Y), magenta (M), cyan (C), and black (K) to form the color image on the sheet.

Transfer unit 20 includes four sets of image forming units 21Y, 21M, 21C, and 21K (hereinafter sometimes collectively referred to as an image forming unit 21), an intermediate transfer belt 22, and a secondary transfer roller 23.

Intermediate transfer belt 22 has a circular shape, and is entrained about a plurality of rollers (not illustrated). Intermediate transfer belt 22 rotates in conjunction with sheet conveying unit 10. Secondary transfer roller 23 is disposed opposite intermediate transfer belt 22 at a position in which secondary transfer roller 23 contacts intermediate transfer belt 22. The sheet is conveyed while nipped between intermediate transfer belt 22 and secondary transfer roller 23.

Each of image forming units 21 are arrayed immediately below intermediate transfer belt 22 to form the Y, M, C, and K images respectively on each photosensitive bodies 24Y, 24M, 24C, and 24K (hereinafter sometimes collectively referred to as a photosensitive body 24). Photosensitive body 24 of each of image forming unit 21 transfers a toner image to intermediate transfer belt 22 to form a mirror image of the four-color toner image, which is formed on the sheet, on intermediate transfer belt 22 (primary transfer). Then the toner image formed on intermediate transfer belt 22 is transferred to the sheet by secondary transfer roller 23 to which a high voltage is applied, thereby forming the toner image on the sheet (secondary transfer). The sheet on which the toner image is formed is conveyed to fixing unit 30.

Fixing unit 30 heats the sheet to fix the image (the toner image) to the sheet. Fixing unit 30 includes a pressurizing roller 31, a heating roller 32, a fixing roller 33, and a fixing belt 34. A heater 35 is incorporated in heating roller 32. For example, heater 35 is turned on by supplying an electric power, thereby heating heating roller 32. Fixing roller 33 is provided between pressurizing roller 31 and heating roller 32, and fixing belt 34 is entrained about heating roller 32 and fixing roller 33. Pressurizing roller 31 contacts a portion of fixing belt 34, which is entrained about fixing roller 33, to form a nip portion that conveys the sheet on which the toner image is formed while nipping the sheet. Pressurizing roller 31 is rotated by a motor (not illustrated). Fixing belt 34 is driven by the rotation of pressurizing roller 31, and heating roller 32 and fixing roller 33 rotate by the rotation of fixing belt 34. Thermistors TM1 and TM2 respectively that measure surface temperatures are provided in heating roller 32 (fixing belt 34) and pressurizing roller 31, respectively. In fixing unit 30, a temperature is adjusted based on the surface temperatures measured by the thermistors TM1 and TM2.

Sheet conveying unit 10 conveys the sheet, which is kept in a sheet feeding tray (sheet feeding port) 40, one by one along a sheet passage route R1 or R2. Sheet conveying unit 10 includes a sheet feeding roller 11, a timing roller 12 (a registration roller), a sheet discharging roller 13, and conveying rollers 14 to 17. Sheet feeding roller 11, timing roller 12, and sheet discharging roller 13 respectively are disposed in this order from an upstream side (the side of sheet feeding tray 40) toward a downstream side (the side of sheet discharging roller 13) in sheet passage route R1. In each of sheet feeding roller 11, timing roller 12, sheet discharging roller 13, and conveying rollers 14 to 17, for example, the sheet is conveyed such that two rollers opposite each other are rotated while the sheet is nipped between the rollers. In addition to the above rollers, sheet conveying unit 10 may includes a roller in order to convey the sheet.

The sheet kept in sheet feeding tray 40 is fed one by one along sheet passage route R1 by sheet feeding roller 11. After the sheet is temporarily stopped in front of timing roller 12, the sheet is conveyed to secondary transfer roller 23 to form the toner image at a predetermined timing. Then the toner image is fixed to the sheet by fixing unit 30, and the sheet is discharged to the outside of the image forming apparatus (the outside of the machine) by sheet discharging roller 13.

In the case of double-sided printing, after the sheet in which the image is formed on the surface passes through fixing unit 30, sheet discharging roller 13 performs switchback of the sheet, and the sheet is conveyed along sheet passage route R2. After the sheet is conveyed along sheet passage route R2 by conveying rollers 14 to 17, the sheet is conveyed along sheet passage route R1 again, and the image is formed on a rear surface of the sheet. Then the sheet is discharged to the outside of the image forming apparatus by sheet discharging roller 13.

Sheet conveying unit 10 further includes a sheet feeding sensor 18 that detects the sheet passage on the downstream side of sheet feeding roller 11 and a timing sensor 19 (registration sensor) that detects the sheet passage on the upstream side of timing roller 12.

Figure 2:
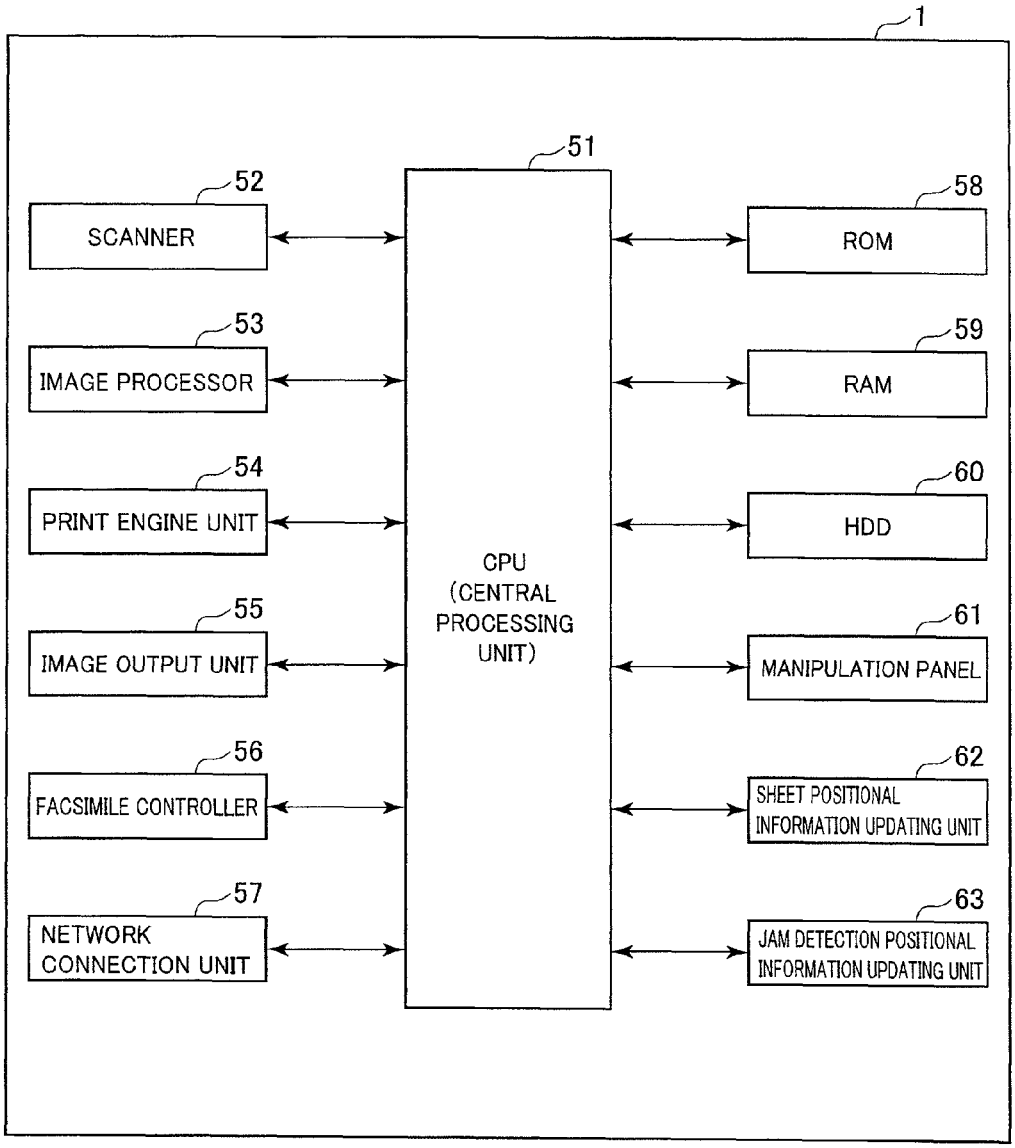
FIG. 2 is a block diagram illustrating a functional configuration of the MFP1 in FIG. 1.

FIG. 2 is a block diagram illustrating a functional configuration of the MFP1 in FIG. 1.

Referring to FIG. 2, the MFP1 includes a CPU (Central Processing Unit) 51 (an example of the controller), a scanner 52, an image processor 53, a print engine unit 54, an image output unit 55, a facsimile controller 56, a network connection unit 57, a ROM (Read Only Memory) 58, a RAM (Random Access Memory) 59, an HDD (Hard Disk Drive) 60, a manipulation panel 61, a sheet positional information updating unit 62 (an example of the first leading end position output unit), and a jam detection positional information updating unit 63 (an example of the second leading end position output unit).

Scanner 52 reads the image of a document. Image processor 53 performs image processing to image data. Print engine unit 54 forms the image on the sheet and the like, based on the image data processed by image processor 53. Image output unit 55 controls processing of outputting the image data. Facsimile controller 56 transmits the image data through a communication line. Network connection unit 57 controls connection between the MFP1 and an external device. For example, a control program for the MFP1 is stored in ROM58. Pieces of data, such as the image data read by scanner 52, are temporarily stored in RAM59. Various pieces of data are stored in HDD60, and HDD60 can rewrite the data. Manipulation panel 61 receives a manipulation of the MFP1 from a user or displays various pieces of information to the user. Sheet positional information updating unit 62 updates pieces of positional information on the leading end and the tailing end of the sheet conveyed in the MFP1 based on the sheet feed amount by the roller conveying the sheet and a detection state of a detection sensor detecting the leading end and the tailing end of the sheet. Jam detection positional information updating unit 63 outputs pieces of jam detection positional information (which are described later) on the leading end and the tailing end of a sheet based on the sheet feed amount by the roller conveying the sheet and the detection state of the detection sensor detecting the leading end and the tailing end of the sheet.

CPU51 controls the whole MFP1 by conducting communication with or transmitting and receiving a signal to and from scanner 52, image processor 53, print engine unit 54, image output unit 55, facsimile controller 56, network connection unit 57, ROM58, RAM59, HDD60, manipulation panel 61, sheet positional information updating unit 62, and jam detection positional information updating unit 63. Particularly, CPU51 controls the drive states of the rollers constituting sheet conveying unit 10 based on the pieces of positional information on the leading end and the tailing end of the sheet, which is output from sheet positional information updating unit 62, and the pieces of jam detection positional information on the leading end and the tailing end of the sheet, which is output from jam detection positional information updating unit 63.

Figure 3:
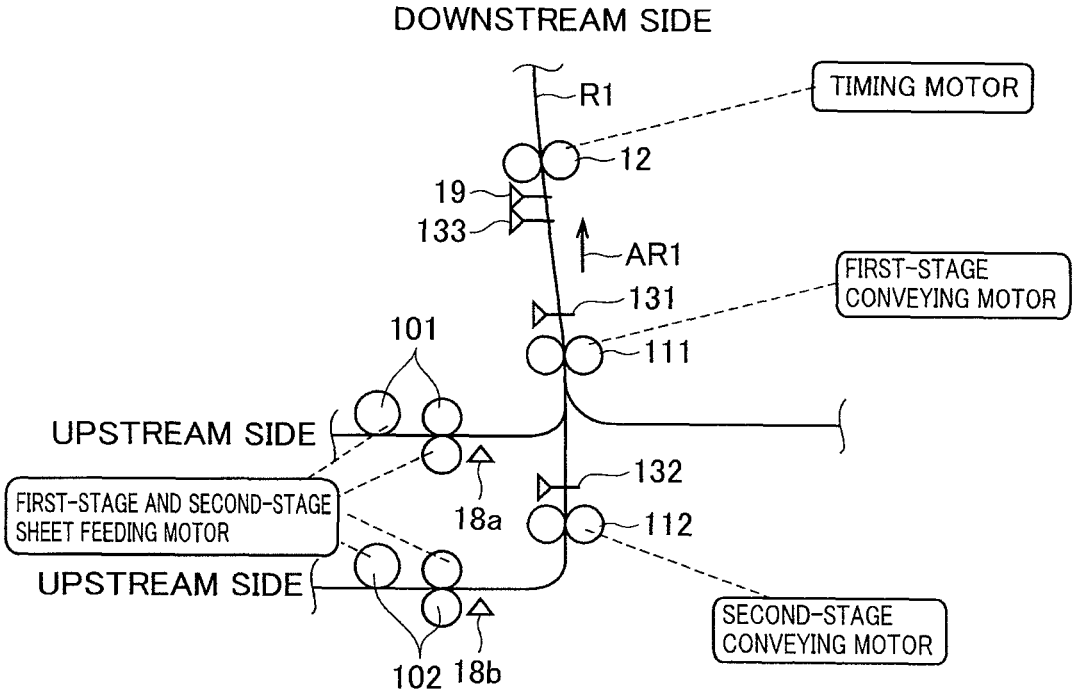
FIG. 3 is a sectional view illustrating specific examples of a sheet feeding mechanism and a vertically conveying mechanism of a sheet conveying unit 10.

FIG. 3 is a sectional view illustrating specific examples of a sheet feeding mechanism and a vertically conveying mechanism of a sheet conveying unit 10.

Referring to FIG. 3, sheet conveying unit 10 includes a first-stage sheet feeding roller 101, a second-stage sheet feeding roller 102, a first-stage vertically conveying roller 111, a second-stage vertically conveying roller 112, timing roller 12, a first-stage sheet feeding sensor 18*a*, a second-stage sheet feeding sensor 18*b*, a first-stage vertically conveyance sensor 131, a second-stage vertically conveyance sensor 132, an OHP (Overhead Projector) detection sensor 133, and timing sensor 19. First-stage sheet feeding roller 101 feeds the sheet from a first-stage sheet feeding tray. Second-stage sheet feeding roller 102 feeds the sheet from a second-stage sheet feeding tray. First-stage vertically conveying roller 111, Second-stage vertically conveying roller 112, and timing roller 12 are provided along a route extending in a vertical direction in sheet passage route R1, and convey the sheet along a sheet passage direction AR1. First-stage sheet feeding sensor 18*a* detects the sheet passage on the downstream side of first-stage sheet feeding roller 101. Second-stage sheet feeding sensor 18*b* detects the sheet passage on the downstream side of second-stage sheet feeding roller 102. First-stage vertically conveyance sensor 131 detects the sheet passage on the downstream side of first-stage vertically conveying roller 111. Second-stage vertically conveyance sensor 132 detects the sheet passage on the downstream side of second-stage vertically conveying roller 112. OHP detection sensor 133 distinguishes an OHP sheet from other sheets. First-stage sheet feeding roller 101 and second-stage sheet feeding roller 102 are driven by first-stage and second-stage sheet feeding motors that can rotate normally and reversely. Timing roller 12 is driven by a timing motor, first-stage vertically conveying roller 111 is driven by a first-stage conveying motor, and second-stage vertically conveying roller 112 is driven by a second-stage conveying motor.

Figure 4:
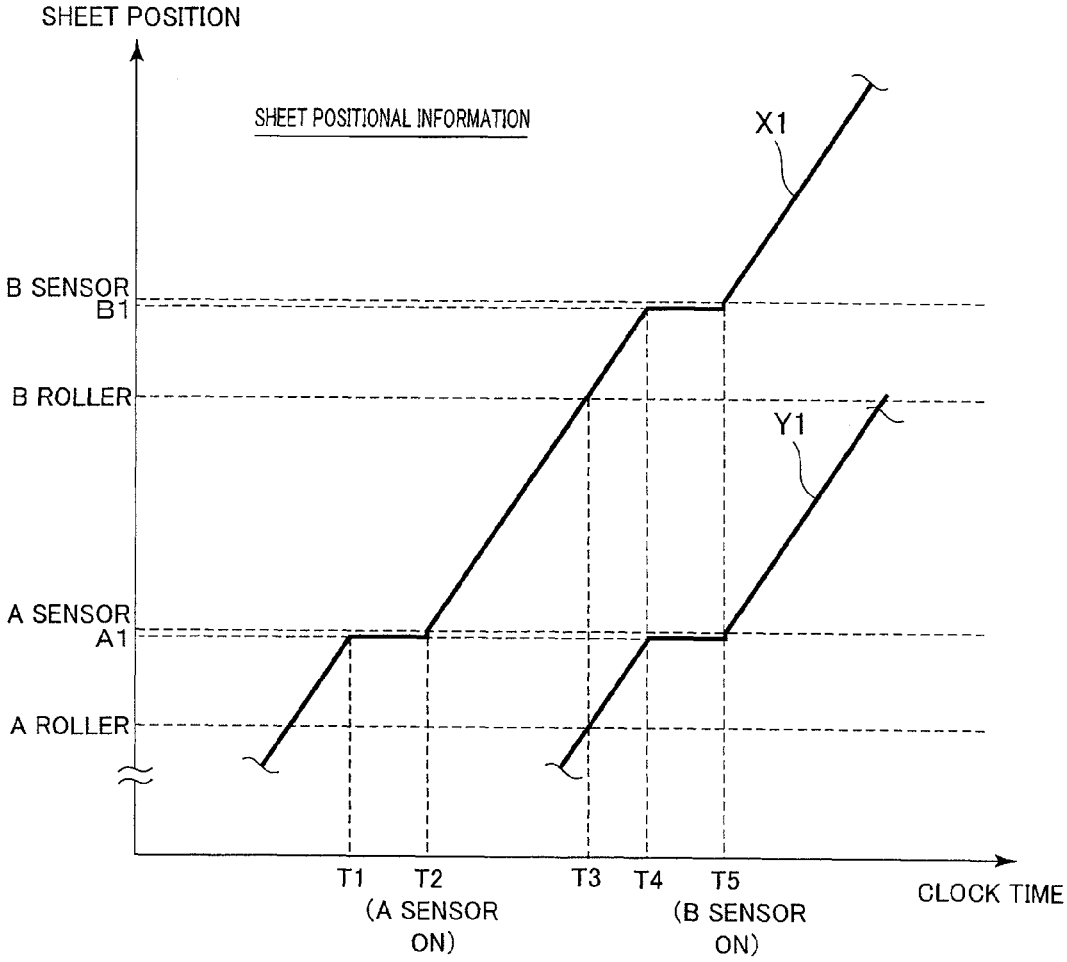
FIG. 4 is a view schematically illustrating a sheet positional information updating method performed by a sheet positional information updating unit (a sheet position update module) 62.

FIG. 4 is a view schematically illustrating a sheet positional information updating method performed by sheet positional information updating unit (sheet position update module) 62. In FIGS. 4, 5, 7, 12, 14, 16, and 17, a vertical axis indicates the sheet position, and a horizontal axis indicates time. An A roller indicates a roller (an example of the first conveying roller) that conveys the sheet on the relatively upstream side, and a B roller indicates a roller (an example of the second conveying roller) that conveys the sheet on the relatively downstream side. An A sensor detects the leading end of the sheet in the detection position on the downstream side of A roller. A B sensor (an example of the detection sensor) detects the leading end of the sheet in the detection position on the downstream side of B roller. For example, A roller indicates second-stage vertically conveying roller 112 in FIG. 3, and B roller indicates first-stage vertically conveying roller 111 in FIG. 3. For example, A sensor indicates second-stage vertically conveyance sensor 132 in FIG. 3, and B sensor indicates first-stage vertically conveyance sensor 131 in FIG. 3. Sheet positional information updating unit 62 outputs the pieces of positional information on the leading end and the tailing end of the sheet. In FIG. 4, a line X1 indicates the positional information on the leading end of the sheet, which is output from sheet positional information updating unit 62, and a line Y1 indicates the positional information on the tailing end of the sheet, which is output from sheet positional information updating unit 62.

Referring to FIG. 4, initially the sheet is conveyed by A roller. Before a clock time T1, sheet positional information updating unit 62 updates the positional information by adding the sheet feed amount of A roller. As a result, the positional information on the leading end of the sheet moves onto the downstream side in proportion to the time.

At clock time T1, it is assumed that A sensor does not detect the leading end of the sheet (does not detect an on-edge position) even if the sheet leading-end position output from sheet positional information updating unit 62 reaches a position A1 (a position immediately in front of A sensor) on the slightly upstream side of the detection position of A sensor. In this case, sheet positional information updating unit 62 stops the update of the positional information on the leading end of the sheet in position A1, and maintains the positional information on the leading end of the sheet in position A1. The situation possibly happens in the case that the deviation is generated between the positional information output from sheet positional information updating unit 62 and the actual sheet leading-end position.

At a clock time T2, when A sensor detects the leading end of the sheet (detects the on-edge position), sheet positional information updating unit 62 resumes the updates of the positional information on the leading end of the sheet with the detection position of A sensor as a starting point. In clock times T2 to T3, sheet positional information updating unit 62 updates the positional information on the leading end of the sheet by adding the sheet feed amount of A roller.

CPU51 (an example of the controller) controls the drive states of A roller and B roller respectively, based on not the detection states of A sensor and B sensor but the positional information output from sheet positional information updating unit 62. Specifically, at clock time T3, when receiving the information indicating that the leading end of the sheet arrives at B roller from sheet positional information updating unit 62, sheet conveying unit 10 starts the drive of B roller and stops the drive of A roller. The timing sheet conveying unit 10 starts the drive of B roller while stopping the drive of A roller is not limited to clock time T3.

In clock times T3 to T4, sheet positional information updating unit 62 updates the positional information on the leading end of the sheet by adding the sheet feed amount of B roller.

At clock time T4, it is assumed that B sensor does not detect the leading end of the sheet (does not detect the on-edge position) even if the sheet leading-end position output from sheet positional information updating unit 62 reaches a position B1 (a position immediately in front of B sensor) on the slightly upstream side of the detection position of B sensor. In this case, sheet positional information updating unit 62 stops the update of the positional information on the leading end of the sheet in position B1, and maintains the positional information on the leading end of the sheet in position B1.

At a clock time T5, when B sensor detects the leading end of the sheet (detects the on-edge position), sheet positional information updating unit 62 resumes the updates of the positional information on the leading end of the sheet with the detection position of B sensor as the starting point.

After clock time T5, sheet positional information updating unit 62 updates the positional information on the leading end of the sheet by adding the sheet feed amount of B roller. As a result, the positional information on the leading end of the sheet moves onto the downstream side in proportion to the time.

As described above, the update of the positional information on the leading end of the sheet is stopped until A sensor and B sensor, which are correction target sensors, detect the on-edge position, whereby the positional information on the leading end of the sheet, which is output from sheet positional information updating unit 62, indicating that the leading end of the sheet is located on the downstream side of the actual sheet leading-end position is suppressed to improve accuracy of the positional information on the leading end of the sheet. As a result, it is not necessary that the sheet feeding and vertically conveying sequence modules that controls the sequence by referring to the positional information on the leading end of the sheet depend on the sensor information.

In FIG. 4, sheet positional information updating unit 62 outputs the position, in which a sheet FD length (a length in a sheet feed direction) is subtracted from the positional information on the leading end of the sheet, as the positional information on the leading end of the sheet.

Figure 5:
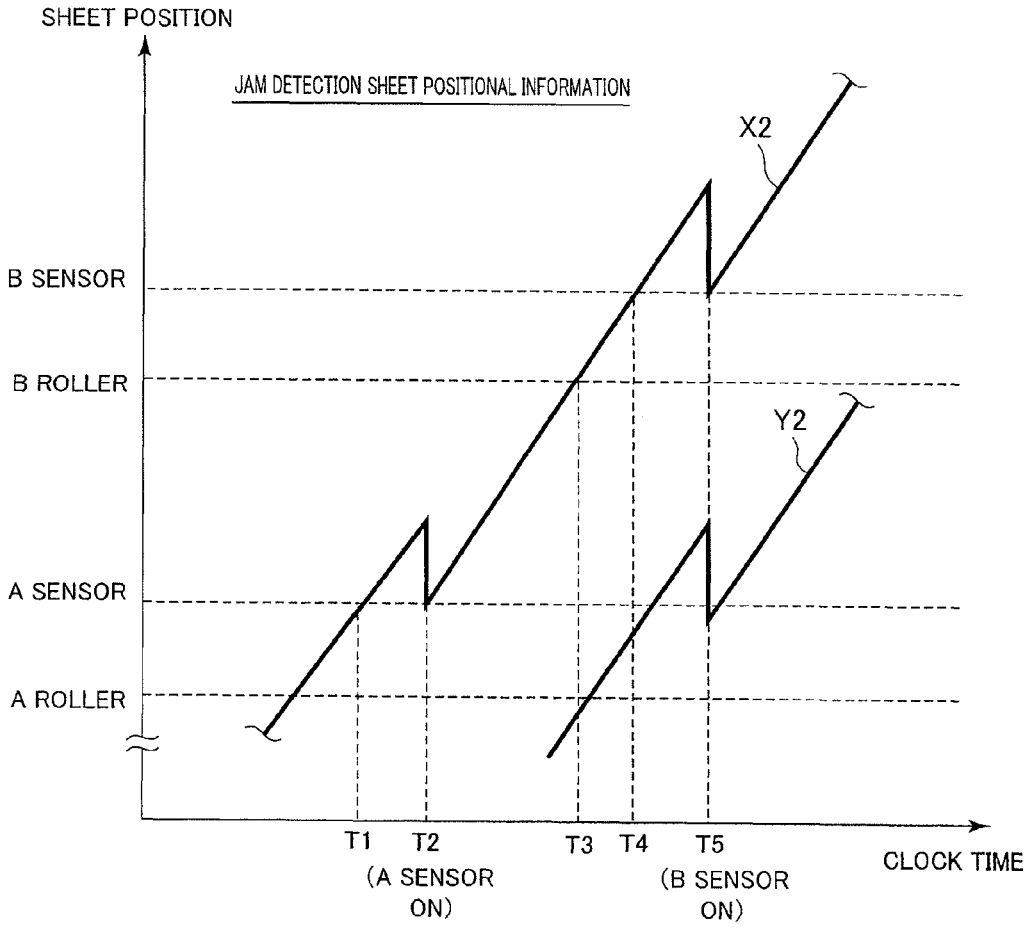
FIG. 5 is a view schematically illustrating a jam detection sheet positional information updating method performed by a jam detection positional information updating unit 63.

FIG. 5 is a view schematically illustrating a jam detection sheet positional information updating method performed by jam detection positional information updating unit 63. In FIG. 5, a line X2 indicates the jam detection positional information on the leading end of the sheet, which is output from jam detection positional information updating unit 63, and a line Y2 indicates the jam detection positional information on the tailing end of the sheet, which is output from jam detection positional information updating unit 63.

Referring to FIG. 5, in order to detect the jam, it is necessary to detect that the actual sheet does not arrive at a target position at the target timing. Jam detection positional information updating unit 63 is provided to detect the target timing. Jam detection positional information updating unit 63 outputs the pieces of jam detection positional information on the leading end and the tailing end of the sheet.

Before clock time T2, jam detection positional information updating unit 63 updates the positional information by adding the sheet feed amount of A roller. Jam detection positional information updating unit 63 continues the update of the jam detection positional information on the leading end of the sheet even if the positional information arrives at position A1 at clock time T1. As a result, the jam detection positional information on the leading end of the sheet moves onto the downstream side in proportion to the time.

At clock time T2, when A sensor detects the leading end of the sheet (detects the on-edge position), jam detection positional information updating unit 63 corrects the positional information on the leading end of the sheet to the detection position of A sensor and continues the updates of the positional information on the leading end of the sheet.

In clock times T2 to T3, jam detection positional information updating unit 63 updates the positional information on the leading end of the sheet by adding the sheet feed amount of A roller. As a result, the positional information on the leading end of the sheet moves onto the downstream side in proportion to the time.

In clock times T3 to T5, jam detection positional information updating unit 63 updates the positional information on the leading end of the sheet by adding the sheet feed amount of B roller. Jam detection positional information updating unit 63 continues the update of the jam detection positional information on the leading end of the sheet even if the positional information arrives at position B1 at clock time T4.

At clock time T5, when B sensor detects the leading end of the sheet (detects the on-edge position), jam detection positional information updating unit 63 corrects the positional information on the leading end of the sheet to the detection position of B sensor and continues the updates of the positional information on the leading end of the sheet.

As described above, jam detection positional information updating unit 63 continues the update of the positional information until the on-edge position is detected even if the jam detection positional information on the leading end of the sheet arrives at the detection position of A sensor or B sensor, which is the correction target sensor, and jam detection positional information updating unit 63 corrects the jam detection positional information on the leading end of the sheet to the detection position of A sensor or B sensor when A sensor or B sensor detects the on-edge position. Therefore, in the case that timing of the detection of the on-edge position by A sensor or B sensor is delayed, a difference is generated between the jam detection positional information on the leading end of the sheet, which is output from jam detection positional information updating unit 63, and the positional information on the leading end of the sheet, which is output from sheet positional information updating unit 62.

CPU51 (an example of the controller) detects the generation of the jam to control the drive states of A roller and B roller based on the difference between the jam detection positional information on the leading end of the sheet, which is output from jam detection positional information updating unit 63, and the positional information on the leading end of the sheet, which is output from sheet positional information updating unit 62. For example, CPU51 determines that the jam is generated in the case that the above-described difference is greater than or equal to a given value. As a result, it is not necessary for the sheet feeding and vertically conveying sequence modules to depend on the unique sensor information on the model in the jam detection, and it is not necessary to set plural jam detection thresholds.

In FIG. 5, jam detection positional information updating unit 63 outputs a position (a position on the upstream side of the sheet leading-end position by the sheet FD length), in which the sheet FD length is subtracted from the jam detection positional information on the leading end of the sheet, as the positional information on the tailing end of the sheet.

Figure 6:
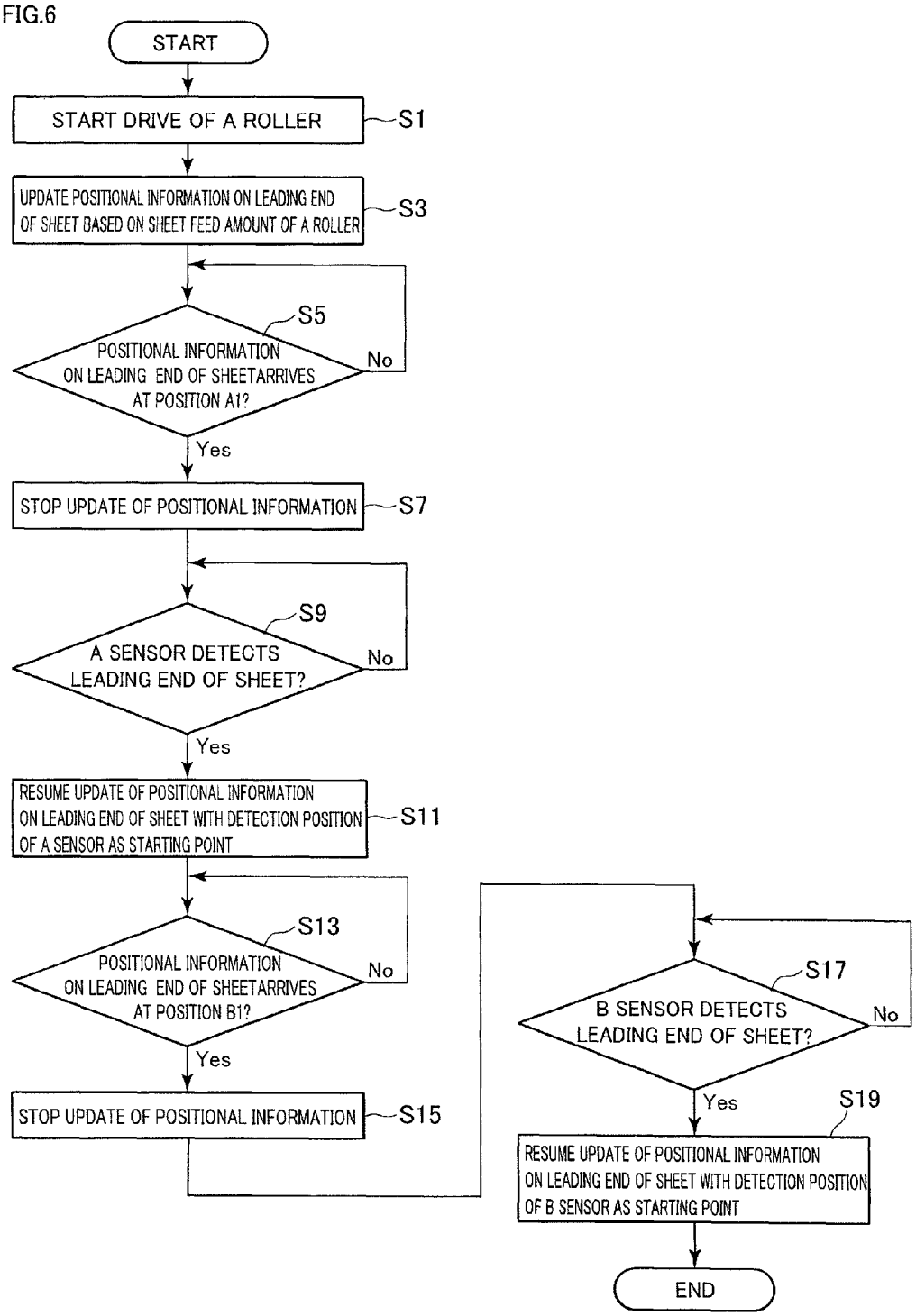
FIG. 6 is a flowchart illustrating an operation of sheet positional information updating unit 62.

FIG. 6 is a flowchart illustrating an operation of sheet positional information updating unit 62. For example, the flowchart in FIG. 6 is performed such that CPU51 loads the control program stored in ROM58.

Referring to FIG. 6, when sheet conveying unit 10 starts the drive of A roller (S1), sheet positional information updating unit 62 updates the positional information on the leading end of the sheet based on the sheet feed amount of A roller (S3). Sheet positional information updating unit 62 determines whether the positional information on the leading end of the sheet arrives at position A1 (S5).

In step S5, when the positional information on the leading end of the sheet arrives at position A1 (Yes in S5), sheet positional information updating unit 62 stops the update of the positional information (S7), and determines whether A sensor detects the leading end of the sheet (S9). On the other hand, in step S5, when the positional information on the leading end of the sheet does not arrive at position A1 (No in S5), sheet positional information updating unit 62 repeats the processing in step S5.

In step S9, when A sensor detects the leading end of the sheet (Yes in S9), sheet positional information updating unit 62 resumes the update of the positional information on the leading end of the sheet with the detection position of A sensor as the starting point (S11), and proceeds to processing in step S13. On the other hand, in step S9, when A sensor does not detect the leading end of the sheet (No in S9), sheet positional information updating unit 62 repeats the processing in step S9. In step S13, sheet positional information updating unit 62 determines whether the positional information on the leading end of the sheet arrives at position B1 (S13).

In step S13, when the positional information on the leading end of the sheet arrives at position B1 (Yes in S13), sheet positional information updating unit 62 stops the update of the positional information (S15), and determines whether B sensor detects the leading end of the sheet (S17). On the other hand, in step S13, when the positional information on the leading end of the sheet does not arrive at the position B1 (No in S13), sheet positional information updating unit 62 repeats the processing in step S13.

In step S17, when B sensor detects the leading end of the sheet (Yes in S17), sheet positional information updating unit 62 resumes the update of the positional information on the leading end of the sheet with the detection position of B sensor as the starting point (S19). Then sheet positional information updating unit 62 ends the processing. On the other hand, in step S17, when B sensor does not detect the leading end of the sheet (No in S17), sheet positional information updating unit 62 repeats the processing in step S17.

According to the first embodiment, in the sheet position updating control in which the positional information on the sheet is calculated from the feed amount of the roller, the update of the positional information on the sheet between the sensor and the roller is stopped until the sensor located on the downstream side of the roller detects the on-edge position, and the sheet position is corrected to the detection position of the sensor when the sensor detects the on-edge position. Therefore, the sheet position can correctly be calculated. It is only necessary for each sequence module that controls the sheet conveying sequence to refer only to the sheet position, and it is not necessary for the sequence module to refer to the detection state of the sensor. In developing a plurality of models of image forming apparatuses different from each other, the design depending on the detection state of the sensor can be eliminated from the sequence module, and it is only necessary to change the setting of the sheet position. As a result, the commonality of the sequence module can be enhanced to improve the software development efficiency.

An effect of the first embodiment will be described in detail by comparing the sheet positional information updating method of the first embodiment to a conventional sheet positional information updating method.

Figure 7:
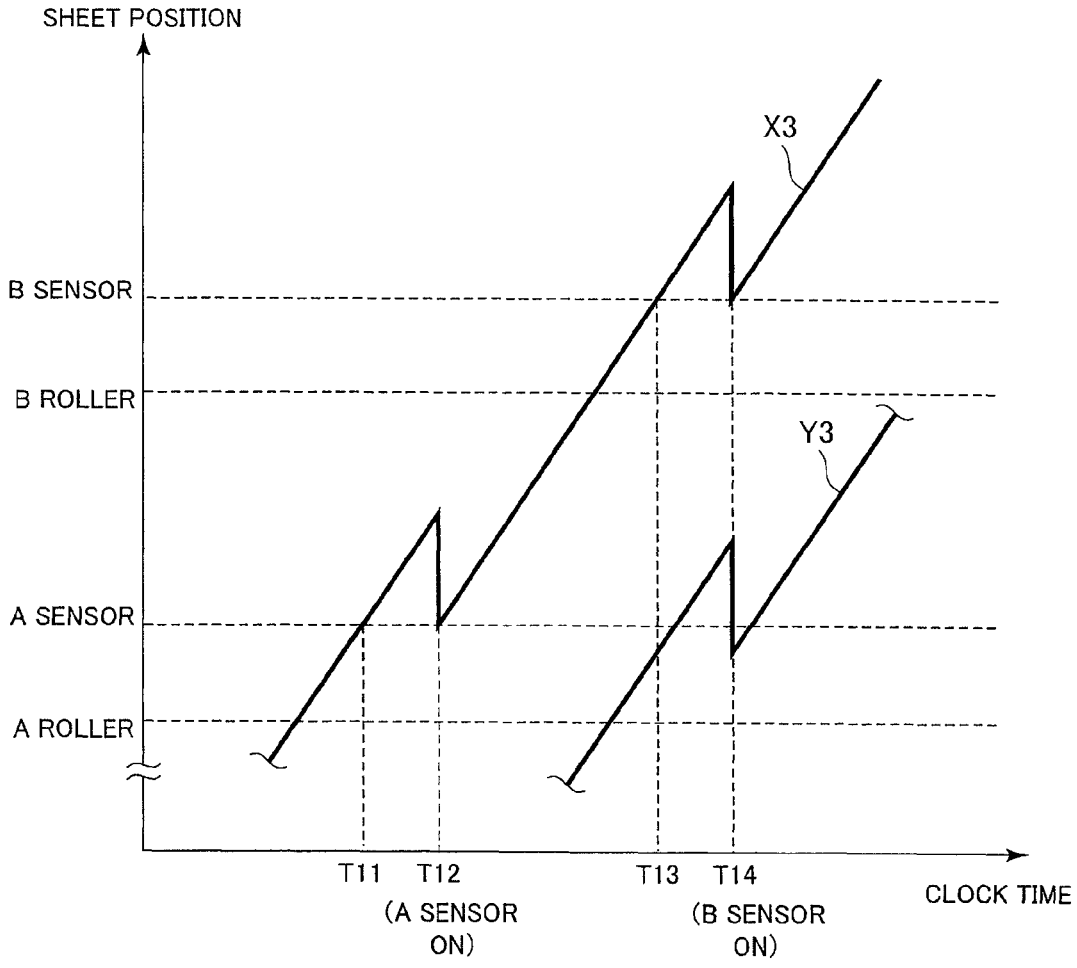
FIG. 7 is a view schematically illustrating a conventional sheet positional information updating method.

FIG. 7 is a view schematically illustrating the conventional sheet positional information updating method. In FIG. 7, a line X3 indicates the positional information on the leading end of the sheet, and a line Y3 indicates the positional information on the tailing end of the sheet.

Referring to FIG. 7, conventionally the positional information on the sheet is basically updated by adding the feed amount of the roller that drives the sheet. In the case that the sensor detects the sheet passage, the positional information on the sheet is corrected to the detection position of the sensor.

Specifically, before a clock time T12, the positional information on the leading end of the sheet is updated by adding the sheet feed amount of A roller. As a result, the positional information on the leading end of the sheet moves onto the downstream side in proportion to the time.

At clock time T12, when A sensor detects the leading end of the sheet, the positional information on the leading end of the sheet is corrected to the detection position of A sensor. Then the update of the positional information on the leading end of the sheet is continued based on the sheet feed amount of A roller.

In clock times T12 to T14, the positional information on the leading end of the sheet is updated by adding the sheet feed amount of A roller. As a result, the positional information on the leading end of the sheet moves onto the downstream side in proportion to the time.

At clock time T14, when B sensor detects the leading end of the sheet, the positional information on the leading end of the sheet is corrected to the detection position of B sensor. At clock time T14, when B sensor detects the leading end of the sheet, the drive of B roller is started and the drive of A roller is stopped. Then the update of the positional information on the leading end of the sheet is continued based on the sheet feed amount of B roller.

After clock time T14, the positional information on the leading end of the sheet is updated by adding the sheet feed amount of B roller. A clock time T11 indicates a clock time in which the positional information on the leading end of the sheet becomes the detection position of A sensor, and a clock time T13 indicates a clock time in which the positional information on the leading end of the sheet becomes the detection position of B sensor. At clock times T11 and T13, the update of the positional information on the leading end of the sheet is not stopped.

The positional information on the tailing end of the sheet is updated as the position in which the sheet FD length is subtracted from the positional information on the leading end of the sheet.

As described above, the conventional positional information on the sheet is corrected to the position of the correction target sensor at the timing the correction target sensor (A sensor or B sensor) is turned on. Therefore, in the case that the sheet conveyance is delayed between A roller and B roller, even if the positional information on the sheet indicates that the leading end of the sheet is located on the downstream side of the detection position of A sensor in clock times T11 to T12, sometimes the leading end of the sheet does not actually arrive at the detection position of A sensor. Similarly, even if the positional information on the sheet indicates that the leading end of the sheet is located on the downstream side of the detection position of B sensor in clock times T13 to T14, sometimes the leading end of the sheet does not actually arrive at the detection position of B sensor. As a result, when the timing the drive of A roller is stopped to start the drive of B roller is decided by referring only to the positional information on the sheet, sometimes the drive of A roller is stopped before the leading end of the sheet arrives at B roller, and the sheet conveyance cannot successfully be turned over. Therefore, there is a problem in that the drive of the roller is switched based only on the positional information on the sheet.

In the conventional control, in consideration of the above problem, the timing the drive of A roller is stopped to start the drive of B roller is decided by referring to both the positional information on the sheet and the detection state of the correction target sensor.

Figure 8:
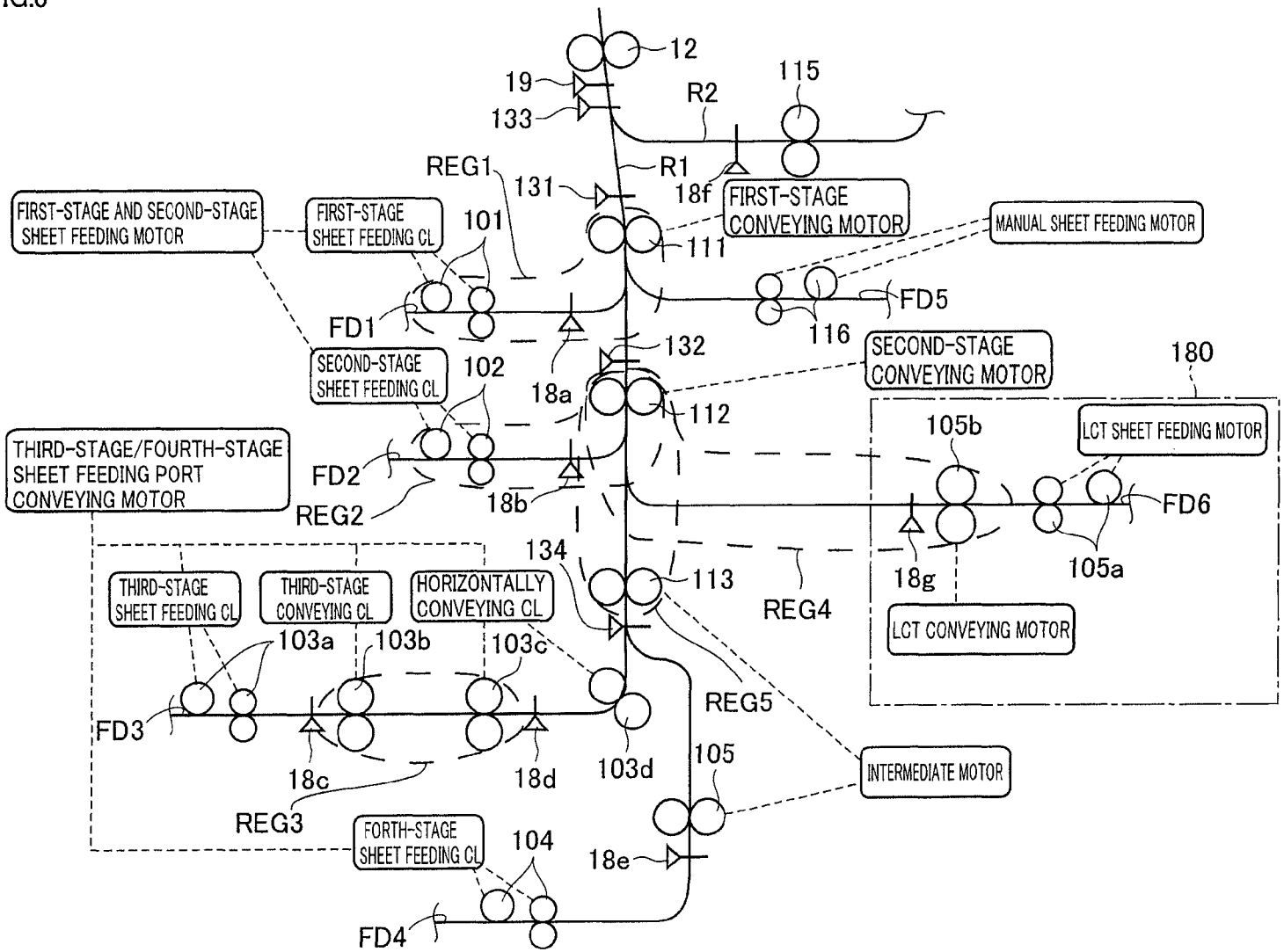
FIG. 8 is a sectional view illustrating a configuration of a conveying mechanism of a sheet passage route from a sheet feeding roller to a timing roller in a conventional image forming apparatus (an A3 machine) that can perform printing to an A3-size sheet.

FIG. 8 is a sectional view illustrating a configuration of a conveying mechanism of the sheet passage route from the sheet feeding roller to the timing roller in a conventional image forming apparatus (an A3 machine) that can perform printing to an A3-size sheet.

Referring to FIG. 8, in the conventional image forming apparatus of the A3 machine, on the left side of the route (the vertically conveying route) extending in the vertical direction of sheet passage route R1, a first-stage sheet feeding port FD1, a second-stage sheet feeding port FD2, a third-stage sheet feeding port FD3, and a fourth-stage sheet feeding port FD4 respectively are sequentially provided as a sheet feeding port for the sheet fed to sheet passage route R1. On the right side of the vertically conveying route, a manual sheet feeding port FD5 and an LCT (large capacity sheet feeding tray) sheet feeding port FD6 respectively are sequentially provided as the sheet feeding port for the sheet fed to sheet passage route R1. In the route extending in the vertical direction of sheet passage route R1, the upper-most sheet passage route on the right side in FIG. 8 is sheet passage route R2 used in the double-sided printing.

First-stage sheet feeding roller 101 and first-stage sheet feeding sensor 18*a* are provided in first-stage sheet feeding port FD1. Second-stage sheet feeding roller 102 and second-stage sheet feeding sensor 18*b* are provided in second-stage sheet feeding port FD2. Each of first-stage sheet feeding roller 101 and second-stage sheet feeding roller 102 is connected to the first-stage and second-stage sheet feeding motor through each of a first-stage sheet feeding CL (clutch) and a second-stage sheet feeding CL. A third-stage sheet feeding roller 103*a*, a third-stage conveying roller 103*b*, a first horizontally conveying roller 103*c*, a second horizontally conveying roller 103*d*, and third-stage sheet feeding sensors 18*c* and 18*d* are provided in third-stage sheet feeding port FD3. A fourth-stage sheet feeding roller 104, a fourth-stage conveying roller 105, and a fourth-stage sheet feeding sensor 18*e* are provided in fourth-stage sheet feeding port FD4. Each of third-stage sheet feeding roller 103*a* and third-stage conveying roller 103*b* is connected to a third-stage/fourth-stage sheet feeding port conveying motor through each of a third-stage sheet feeding CL and a third-stage conveying CL. First horizontally conveying roller 103*c* and second horizontally conveying roller 103*d* respectively are connected to the third-stage/fourth-stage sheet feeding port conveying motor through a horizontally conveying CL. Fourth-stage sheet feeding roller 104 is connected to the third-stage/fourth-stage sheet feeding port conveying motor with a fourth-stage sheet feeding CL interposed therebetween. Fourth-stage conveying roller 105 is connected to an intermediate motor.

An ADU (Automatic Duplex copy Unit) conveying roller 115 and an ADU sensor 18*f* are provided in sheet passage route R2. A manual sheet feeding roller 116 is provided in manual sheet feeding port FD5. Manual sheet feeding roller 116 is connected to a manual sheet feeding motor. LCT sheet feeding port FD6 is an external LCT180. An LCT sheet feeding roller 105*a*, an LCT conveying roller 105*b*, and a conveyance sensor 18*g* are provided in the LCT sheet feeding port FD6. LCT sheet feeding roller 105*a* is connected to an LCT sheet feeding motor. LCT conveying roller 105*b* is connected to an LCT conveying motor.

Timing roller 12, first-stage vertically conveying roller 111, second-stage vertically conveying roller 112, intermediate roller 113, timing sensor 19, OHP detection sensor 133, first-stage vertically conveyance sensor 131, second-stage vertically conveyance sensor 132, and intermediate roller sensor 134 are provided in the vertically conveying route. First-stage vertically conveying roller 111 is connected to the first-stage conveying motor. Second-stage vertically conveying roller 112 is connected to the second-stage conveying motor. Intermediate roller 113 is connected to the intermediate motor.

The control, in which the sheet feeding roller is driven to convey the sheet to the downstream-side roller, is performed in each sheet feeding port. The control, in which the drive is switched between a plurality of rollers, is performed in each sheet feeding port. For example, the drive of first-stage sheet feeding roller 101 is started in the case that the sheet is fed from first-stage sheet feeding port FD1, and the drive of first-stage sheet feeding roller 101 is stopped in the case that the leading end of the sheet is detected by first-stage vertically conveyance sensor 131 beyond first-stage vertically conveying roller 111. The same sheet feeding control is performed in other sheet feeding ports.

In the route extending in the vertical direction of sheet passage route R1, the control, in which the sheet fed from the sheet feeding port is conveyed to timing roller 12 by properly driving the vertically conveying roller, is performed. In this case, the control in which the drive is switched between a plurality of rollers is performed. For example, in the case that the sheet is fed from third-stage sheet feeding port FD3, the drive of intermediate roller 113 is started when intermediate roller sensor 134 detects the leading end of the sheet, and the drive of intermediate roller 113 is stopped when second-stage vertically conveyance sensor 132 detects the leading end of the sheet.

As described above, conventionally the drive switching between a plurality of rollers (the drive turn-over between the rollers) is controlled based on the positional information on the sheet and the detection state of the detection sensor disposed on the downstream side of the destination roller (the downstream-side roller) of the turn-over.

The control is performed in a region REG1 (first-stage sheet feeding roller 101 to first-stage vertically conveying roller 111), a region REG2 (second-stage sheet feeding roller 102 to second-stage vertically conveying roller 112), a region REG3 (third-stage conveying roller 103*b* to first horizontally conveying roller 103*c*), a region REG4 (LCT sheet feeding roller 105*b* to second-stage vertically conveying roller 112), and a region REG5 (intermediate roller 113 to second-stage vertically conveying roller 112) in FIG. 8.

Figure 9:
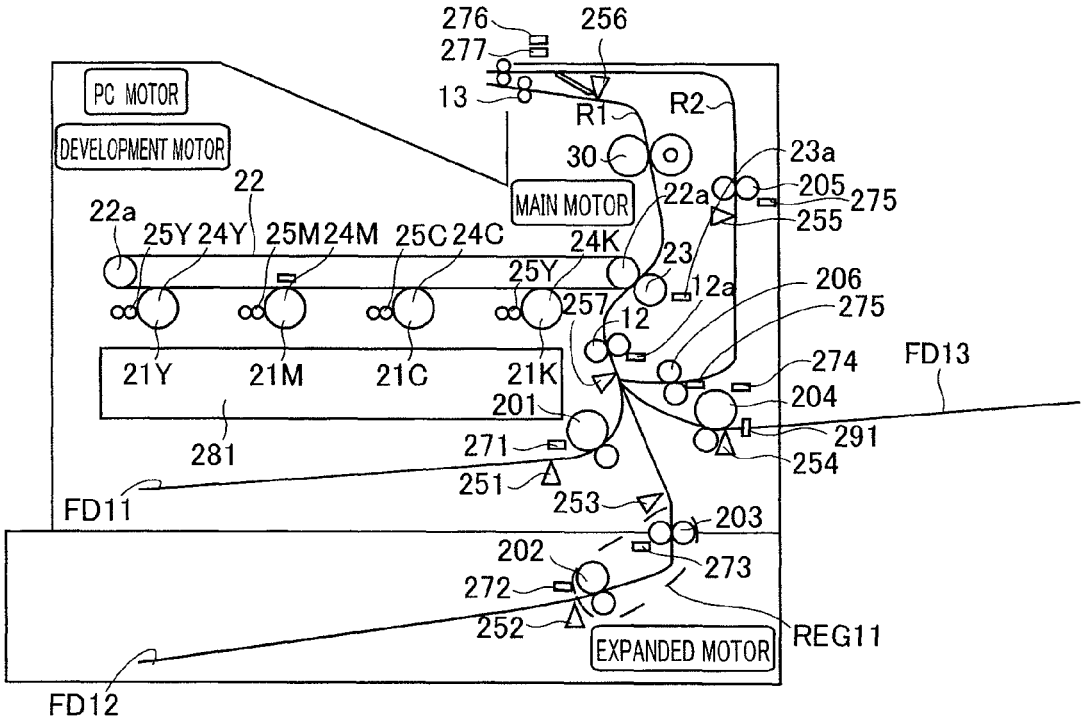
FIG. 9 is a sectional view illustrating a configuration of a conventional image forming apparatus (an A4 machine) that can perform printing to an A4-size sheet.

FIG. 9 is a sectional view illustrating a configuration of a conventional image forming apparatus (an A4 machine) that can perform printing to an A4-size sheet.

Referring to FIG. 9, in the conventional image forming apparatus of the A4 machine, on the left side of the route extending in the vertical direction of sheet passage route R1, a main-body sheet feeding port FD11 and an expanded sheet feeding port FD12 respectively are sequentially provided as the sheet feeding port for the sheet fed to sheet passage route R1. On the right side of the vertically conveying route, a manual sheet feeding port FD13 is provided as the sheet feeding port for the sheet fed to sheet passage route R1.

A cassette sheet feeding roller 201, a cassette empty sensor 251, and a cassette sheet feeding CL 271 are provided in main-body sheet feeding port FD11. An expanded cassette sheet feeding roller 202, an expanded conveying roller 203, an expanded cassette empty sensor 252, an expanded jam sensor 253, an expanded cassette sheet feeding CL 272, and an expanded cassette conveying CL 273 are provided in expanded sheet feeding port FD12. An MPT (Multi Purpose Tray) roller 204, an MPT empty sensor 254, an MPT sheet feeding CL 274, and an MPT lifting plate 291 are provided in manual sheet feeding port FD13. A DUP first conveying roller 205, a DUP second conveying roller 206, a DUP conveying CL 275(double-sided storing unit), and a DUP conveyance sensor 255 are provided in sheet passage route R2.

Sheet discharging roller 13, secondary transfer roller 23, a secondary-transfer contacting and separating SL (solenoid)

23*a*, timing roller 12, a timing CL 12*a*, and sensors 256 and 257 are provided in the vertically conveying route. A sheet discharge normal rotation CL 276 and a sheet discharge reverse rotation CL 277 are provided above sheet discharging roller 13.

The conventional image forming apparatus of the A4 machine further includes a printhead 281, image forming units 21Y, 21M, 21C, and 21K, intermediate transfer belt 22, a roller 22*a*, and fixing unit 30. Image forming units 21Y, 21M, 21C, and 21K include photosensitive bodies 24Y, 24M, 24C, and 24K and development devices 25Y, 25M, 25C, and 25K (hereinafter sometimes collectively referred to as a development device 25), respectively. Development device 25 of the image forming unit 21 is driven by a development motor. Particularly, in the case that the image forming apparatus performs the color printing, the development motor rotates normally to drive four development devices 25Y, 25M, 25C, and 25K. On the other hand, in the case that the image forming apparatus performs the monochrome printing, the development motor rotates reversely to drive only development device 25K. Each of photosensitive bodies 24Y, 24M, and 24C is driven by a PC motor. Photosensitive body 24K, roller 22*a*, discharge roller 13, fixing unit 30, secondary transfer roller 23, timing roller 12, cassette sheet feeding roller 201, DUP first conveying roller 205, DUP second conveying roller 206, and MPT roller 204 are driven by a main motor.

Compared with the conventional image forming apparatus of the A3 machine, the conventional image forming apparatus of the A4 machine is compact because the numbers of sheet feeding ports and conveyance sensors decrease. Accordingly, only the region REG11 (expanded cassette sheet feeding roller 202 to expanded conveying roller 203) is the point at which the drive switching between a plurality of rollers is controlled based on the positional information on the sheet and the detection state of the detection sensor.

As described with reference to FIGS. 8 and 9, although the same control is performed in the A3 machine and the A4 machine, the position of the sensor depends on the mechanism. In the conventional image forming apparatus, because the operation of sheet conveying unit 10 depends on the detection state of the sensor, the sheet feeding control and the vertically conveying control are not common in the two models.

Figure 10:
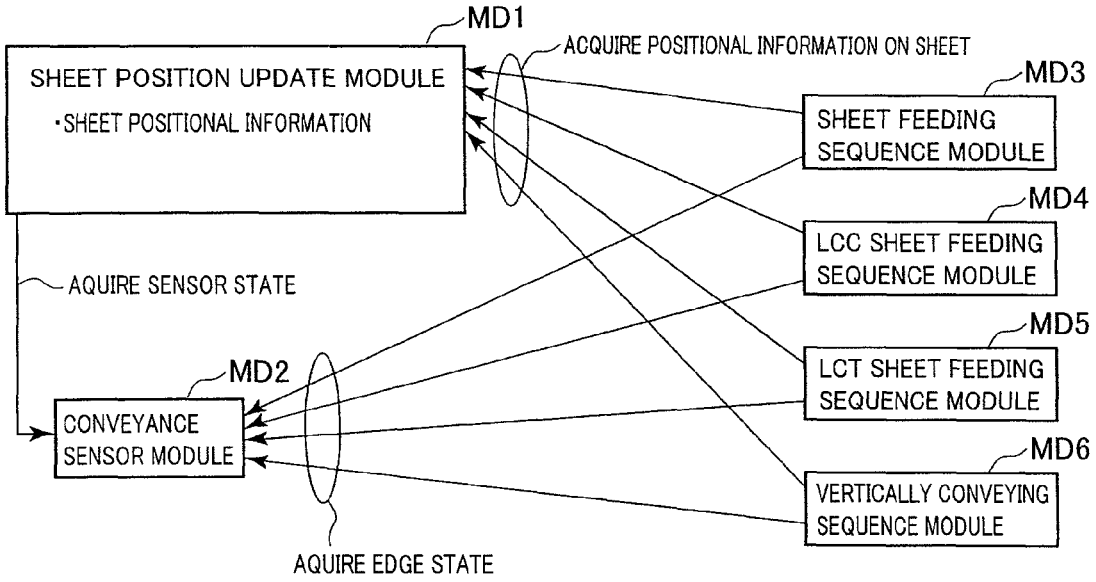
FIG. 10 is a view illustrating a software structure of a control program (sheet feeding and conveying control program) of a conventional sheet conveying device.

FIG. 10 is a view illustrating a software structure of a control program (sheet feeding and conveying control program) of the conventional sheet conveying device.

Referring to FIG. 10, the control program of the sheet conveying device includes a sheet position update module MD1 that updates and retains the positional information on the sheet, a conveyance sensor module MD2 that has information on the detection state of each detection sensor (conveyance sensor) provided in the image forming apparatus, a sheet feeding sequence module MD3 that acquires the positional information on the sheet to perform sequence control of the sheet feeding mechanism according to the sheet position, an LCC sheet feeding sequence module MD4 that acquires the positional information on the sheet to perform sequence control of the expanded cassette mechanisms of the LCC (large-capacity sheet feeding cassette) and the LCT respectively, an LCT sheet feeding sequence module MD5, and a vertically conveying sequence module MD6 that performs sequence control of the vertically conveying mechanism.

In the conventional control program, it is necessary that sheet feeding sequence module MD3, LCC sheet feeding sequence module MD4, LCT sheet feeding sequence module MD5, and vertically conveying sequence module MD6 need to perform the sequence control by referring to not only the positional information on the sheet, which is possessed by the sheet position update module MD1, but also the detection state (an edge state) of the detection sensor, which is possessed by the conveyance sensor module MD2. Therefore, when the number of detection sensors or the position of the detection sensor is changed, the change of the sequence module is generated in each case.

Figure 11:
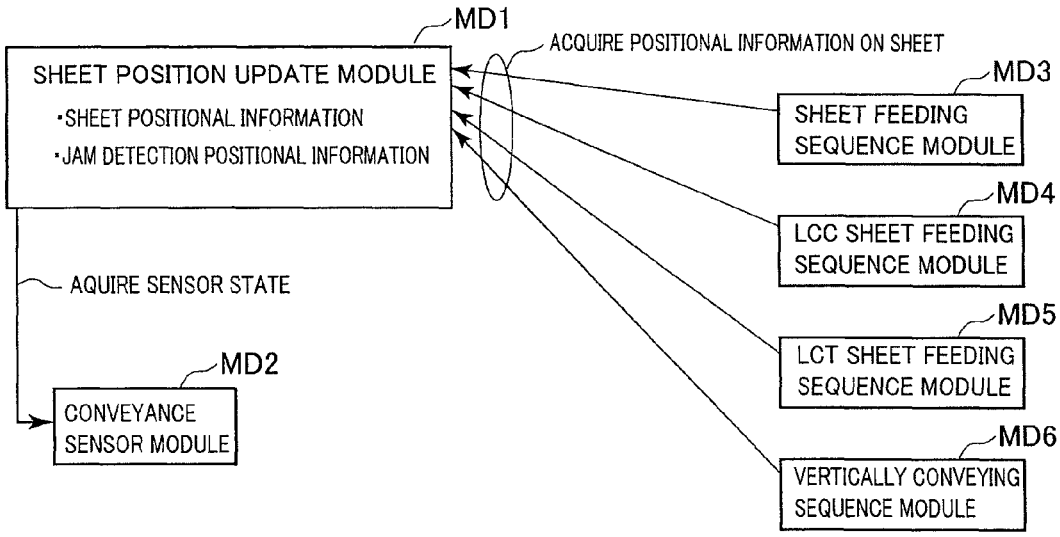
FIG. 11 is a view schematically illustrating a software structure of a control program (a sheet feeding and conveying control program) of an image forming apparatus according to an embodiment of the present invention.

FIG. 11 is a view schematically illustrating a software structure of a control program (a sheet feeding and conveying control program) of an image forming apparatus according to an embodiment of the present invention.

Referring to FIG. 11, in the control program of the first embodiment, the detection state of the detection sensor, which is possessed by conveyance sensor module MD2, is used only in sheet position update module MD1. Sheet feeding sequence module MD3, LCC sheet feeding sequence module MD4, LCT sheet feeding sequence module MD5, and vertically conveying sequence module MD6 refer only to the positional information on the sheet possessed by sheet position update module MD1, but it is not necessary that modules MD3 to MD6 acquire the sensor information possessed by conveyance sensor module MD2. Accordingly, only parameters for start-up and stop positions of the mechanism are changed in each model, but it is not necessary to change a sequence algorithm. As a result, the commonality of the sequence module can be promoted in a plurality of models to simplify the device configuration.

Second Embodiment

The case that sheet positional information updating unit 62 updates the positional information on the tailing end of the sheet using the similar method for updating the positional information on the leading end of the sheet according to the first embodiment will be described in a second embodiment.

Figure 12:
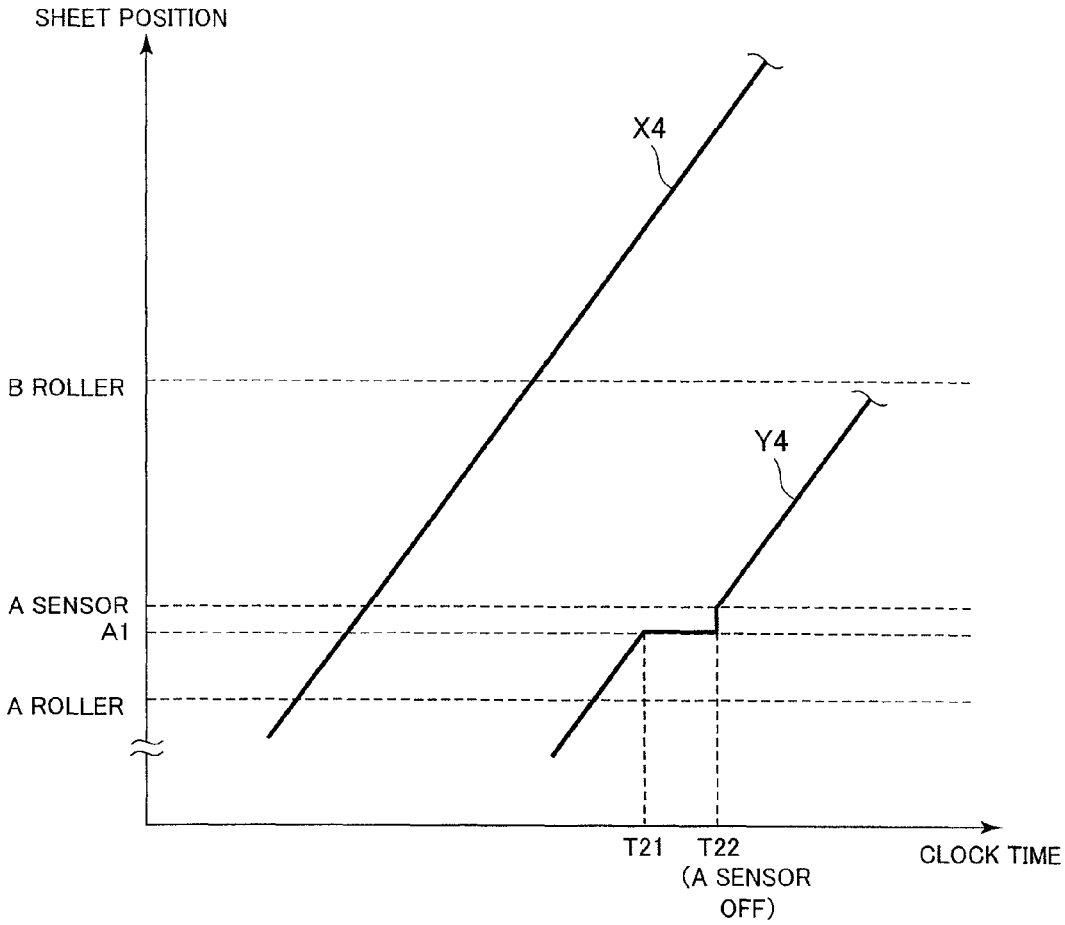
FIG. 12 is a view schematically illustrating the sheet positional information updating method performed by the sheet positional information updating unit (the sheet position update module) 62.

FIG. 12 is a view schematically illustrating the sheet positional information updating method performed by sheet positional information updating unit (sheet position update module) 62. In FIG. 12, a line X4 indicates the positional information on the leading end of the sheet, and a line Y4 indicates the positional information on the tailing end of the sheet. In FIG. 12, for example, A roller indicates first-stage sheet feeding roller 101 in FIG. 8, and B roller indicates first-stage vertically conveying roller 111 in FIG. 8. For example, A sensor indicates first-stage sheet feeding sensor 18*a* in FIG. 8.

Referring to FIG. 12, when the sheet conveyed by A roller arrives at B roller beyond A sensor, the drive of B roller is started and the drive of A roller is stopped. As a result, the sheet is conveyed by the B roller.

Before a clock time T21, sheet positional information updating unit 62 outputs the position, in which the sheet FD length is subtracted from the positional information on the leading end of the sheet, as the positional information on the tailing end of the sheet.

At clock time T21, it is assumed that A sensor does not detect the tailing end of the sheet (does not detect an off-edge position) even if the sheet tailing-end position output from sheet positional information updating unit 62 arrives at position A1. In this case, sheet positional information updating unit 62 stops the update of the positional information on the tailing end of the sheet in position A1, and maintains the positional information on the tailing end of the sheet in position A1. The situation possibly happens in the case that the deviation is generated between the positional information output from sheet positional information updating unit 62 and the actual sheet tailing-end position.

At a clock time T22, when A sensor detects the leading end of the sheet (detects the off-edge position), sheet positional information updating unit 62 resumes the updates of the positional information on the tailing end of the sheet with the detection position of A sensor as a starting point. After clock time T22, sheet positional information updating unit 62 outputs the position, in which the sheet FD length is subtracted from the positional information on the leading end of the sheet, as the positional information on the tailing end of the sheet.

Because the configuration and other pieces of processing of the image forming apparatus of the second embodiment are identical to those of the first embodiment, the description is not repeated here.

According to the second embodiment, the positional information on the tailing end of the sheet is not updated until A sensor detects the off-edge position, so that the sheet tailing-end position can correctly be calculated. As a result, the sheet FD length can be detected by the difference between the positional information on the leading end of the sheet and the sheet tailing-end position, and the sheet FD length can easily be detected without fixing the point at which the sheet length is detected.

Additionally, in the case that the length of the sheet in which the setting is accepted by the image forming apparatus differs from the length of the sheet to which the sheet passage is actually performed (that is, in the case that the sheet to which the sheet passage is actually performed has the size in which a size error is generated), the size error is easy to detect. For example, it is assumed that the sheet in which the setting is accepted by the image forming apparatus has the length of 216 mm, and that the difference between the positional information on the leading end of the sheet and the positional information on the tailing end of the sheet is 250 mm. In the case that the image forming apparatus determines that the sheet having the size exceeding (216 mm+30 mm) is the size error, the image forming apparatus determines that the sheet is the size error.

Moreover, the sheet passage of the sheet having the size in which the size error is generated can normally be performed without largely changing the program.

Third Embodiment

The case that an off-edge detection starting position of the sensor is located on the upstream side of an on-edge detection starting position will be described in a third embodiment.

Figure 13:
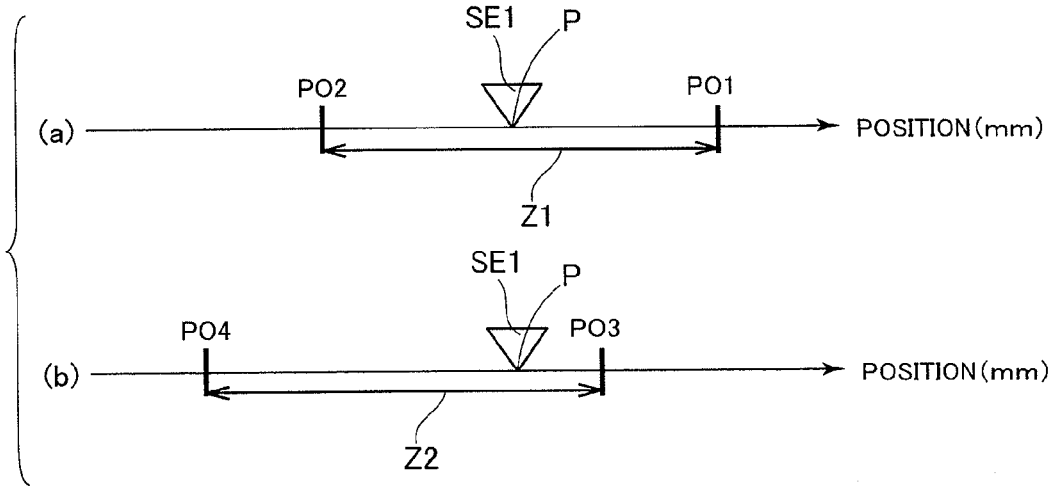
FIG. 13 is a view illustrating a relationship between an off-edge detection starting position and an on-edge detection starting position of a sensor SE1.

FIG. 13 is a view illustrating a relationship between an off-edge detection starting position and an on-edge detection starting position of a sensor SE1. Sensor SE1 is an arbitrary sensor provided in sheet passage route R1 or R2 of the image forming apparatus.

Referring to FIG. 13, based on a clock time at which the feeding of the A4-size sheet is started from sheet feeding tray 40, it is assumed that the leading end of the sheet passes by sensor SE1 after 0.4 to 0.6 seconds elapse, and that the tailing end of the sheet passes by sensor SE1 after 0.1 seconds elapse since the leading end of the sheet passes by sensor SE1.

In the case that the setting is performed in the image forming apparatus such that sensor SE1 detects the passage of the leading end of the sheet (detects the on-edge position) after 0.5 seconds elapse based on the reference clock time, as illustrated in FIG. 13(*a*), sensor SE1 detects the leading end of the sheet in the detection position within a range Z1 in the sheet passage route. The reason the detection position has the range is that the clock time at which the leading end of the sheet passes by sensor SE1 varies. Specifically, in the earliest case that the leading end of the sheet arrives at sensor SE1 (in the case that the leading end of the sheet passes by sensor SE1 after 0.4 seconds elapse based on the reference clock time), sensor SE1 detects the leading end of the sheet in a position PO1. In the latest case that the leading end of the sheet arrives at sensor SE1 (in the case that the leading end of the sheet passes by sensor SE1 after 0.6 seconds elapse based on the reference clock time), sensor SE1 detects the leading end of the sheet in a position PO2. Position PO2 is a position (the on-edge detection starting position) on the most upstream side of the sheet passage route in range Z1.

In the case that the setting is performed in the image forming apparatus such that sensor SE1 detects the passage of the tailing end of the sheet (detects the off-edge position) after 0.6 seconds elapse based on the reference clock time, sensor SE1 detects the tailing end of the sheet in the detection position within range Z1 in the sheet passage route. Specifically, in the earliest case that the tailing end of the sheet arrives at sensor SE1 (in the case that the tailing end of the sheet passes by sensor SE1 after 0.5 seconds elapse based on the reference clock time), sensor SE1 detects the tailing end of the sheet in position PO1. In the latest case that the tailing end of the sheet arrives at sensor SE1 (in the case that the tailing end of the sheet passes by sensor SE1 after 0.6 seconds elapse based on the reference clock time), sensor SE1 detects the tailing end of the sheet in position PO2. Position PO1 is a position on the most upstream side of the sheet passage route in range Z1. That is, in this case, sensor SE1 detects both the leading end of the sheet and the tailing end of the sheet in the detection positions within range Z1.

On the other hand, in the third embodiment, the time sensor SE1 detects the existence or non-existence of the passage of the tailing end of the sheet (detects the off-edge position) is set earlier than the case in FIG. 13(*a*) (for example, after 0.58 seconds elapse based on the reference clock time). In this case, sensor SE1 detects the tailing end of the sheet in the detection position within a range Z2 in the sheet passage route. Specifically, in the earliest case that the tailing end of the sheet arrives at sensor SE1 (in the case that the tailing end of the sheet passes by sensor SE1 after 0.5 seconds elapse based on the reference clock time), sensor SE1 detects the tailing end of the sheet in a position PO3. In the latest case that the tailing end of the sheet arrives at sensor SE1 (in the case that the tailing end of the sheet passes by sensor SE1 after 0.6 seconds elapse based on the reference clock time), sensor SE1 detects the tailing end of the sheet in a position PO4. Position PO4 is a position (the off-edge detection starting position), which is located on the most upstream side of the sheet passage route in range Z2 and located on the upstream side of position PO2. That is, in the case in FIG. 13(*b*), the off-edge detection starting position is located on the upstream side of the on-edge detection starting position.

Because the configuration and other pieces of processing of the image forming apparatus of the third embodiment are identical to those of the first embodiment, the description is not repeated here.

According to the third embodiment, as illustrated in FIG. 13(*b*), the off-edge detection starting position of sensor SE1 is set to the upstream side of the on-edge detection starting position of sensor SE1. Therefore, in the case that the actual sheet FD length is shorter than the assumed sheet FD length, sensor SE1 can be prevented from skipping the off-edge position, and the determination that the skip of the off-edge position is the generation of the jam can be prevented. As a result, the sheet passage can be performed to the size-error sheet in which the actual sheet FD length is shorter than the assumed sheet FD length.

Fourth Embodiment

The case that necessity for sheet feeding retry (rerun of sheet feeding) and the existence or non-existence of the generation of the sheet feeding jam are determined based on the positional information on the sheet and the jam detection positional information on the sheet will be described in a fourth embodiment.

Figure 14:
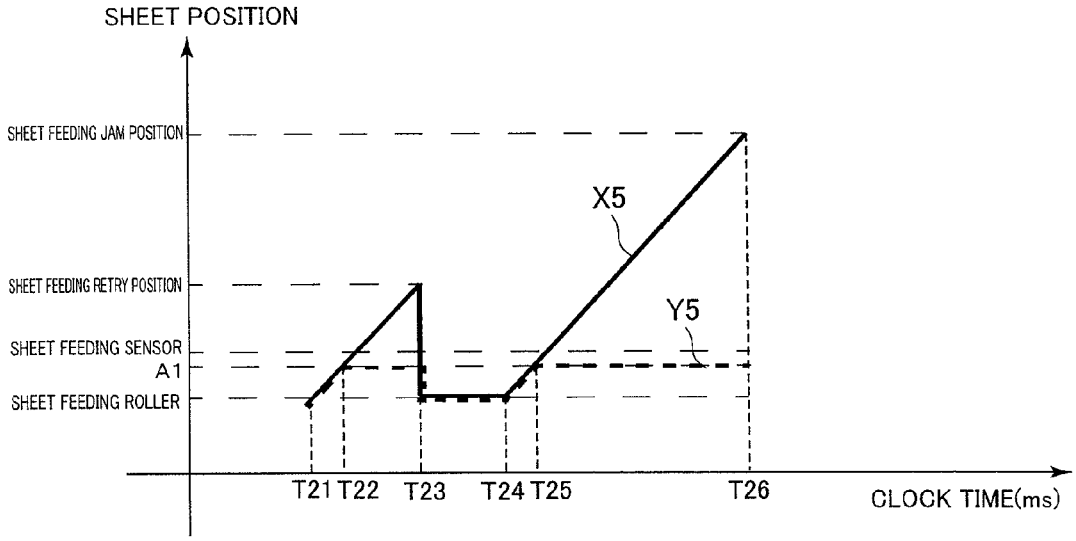
FIG. 14 is a view schematically illustrating a clock time change of jam detection positional information on a leading end of a sheet, which is output from jam detection positional information updating unit 63, and a clock time change of positional information on a leading end of a sheet, which is output from sheet positional information updating unit 62, in the case of determination whether sheet feeding retry is required and whether a sheet feeding jam is generated.

FIG. 14 is a view schematically illustrating a clock time change of the jam detection positional information on the leading end of the sheet, which is output from jam detection positional information updating unit 63, and a clock time change of the positional information on the leading end of the sheet, which is output from sheet positional information updating unit 62, in the case of determination whether sheet feeding retry is required and whether a sheet feeding jam is generated. In FIG. 14, a vertical axis indicates the sheet position, and a horizontal axis indicates time. A line X5 indicates the jam detection positional information on the leading end of the sheet, which is output from jam detection positional information updating unit 63, and a line Y5 indicates the positional information on the leading end of the sheet, which is output from sheet positional information updating unit 62.

Referring to FIG. 14, the sheet feeding sensor is provided on the downstream side of the sheet feeding roller, and a sheet feeding retry position and a sheet feeding jam position are set on the downstream side of the sheet feeding sensor. Although the sheet feeding retry position and the sheet feeding jam position can be set in arbitrary positions, the necessity for the sheet feeding retry and the existence or non-existence of the generation of the sheet feeding jam can be determined in the proper order by setting the sheet feeding retry position on the upstream side of the sheet feeding jam position.

At clock time T21, when the sheet is fed from sheet feeding tray 40, jam detection positional information updating unit 63 and sheet positional information updating unit 62 add the sheet feed amount of the sheet feeding roller to update the pieces of positional information, then output the pieces of information.

At clock time T22, in the case that the sheet feeding sensor does not detect the leading end of the sheet even if the positional information on the leading end of the sheet arrives at position A1 on the slightly upstream side of the detection position of the sheet feeding sensor, sheet positional information updating unit 62 stops the update of the positional information on the leading end of the sheet in position A1, and maintains the positional information on the leading end of the sheet in position A1. On the other hand, jam detection positional information updating unit 63 continues the update of the positional information based on the sheet feed amount of the sheet feeding roller.

At a clock time T23, in the case that the jam detection positional information on the leading end of the sheet arrives at the sheet feeding retry position although the positional information on the leading end of the sheet does not arrive at the detection position of the sheet feeding sensor, CPU51 performs the sheet feeding retry. The sheet feeding retry means an operation, in which the sheet feeding is resumed by driving the sheet feeding roller after the sheet feeding roller is stopped for a given time in the case that the sheet is not fed to the sheet feeding roller although the sheet feeding roller is driven. In this case, jam detection positional information updating unit 63 and sheet positional information updating unit 62 respectively return (correct) the jam detection positional information on the leading end of the sheet and the positional information on the leading end of the sheet to the position (sheet feeding starting position) of the sheet feeding roller. At a clock time T24, when the sheet feeding is resumed, jam detection positional information updating unit 63 and sheet positional information updating unit 62 respectively resume the update of the positional information based on the sheet feed amount of the sheet feeding roller. Therefore, in the case that the sheet feeding retry is performed, the jam detection positional information on the leading end of the sheet and the positional information on the leading end of the sheet can correctly be calculated.

At a clock time T25, in the case that the sheet feeding sensor does not detect the leading end of the sheet even if the positional information on the leading end of the sheet arrives at position A1 on the slightly upstream side of the detection position of the sheet feeding sensor, sheet positional information updating unit 62 stops the update of the positional information on the leading end of the sheet in position A1, and maintains the positional information on the leading end of the sheet in position A1. On the other hand, jam detection positional information updating unit 63 continues the update of the positional information based on the sheet feed amount of the sheet feeding roller.

At a clock time T26, in the case that the jam detection positional information on the leading end of the sheet arrives at the sheet feeding jam position although the positional information on the leading end of the sheet does not arrive at the detection position of the sheet feeding sensor, CPU51 determines that the sheet feeding jam is generated and stops the sheet feeding.

Instead of or together with the above method, the necessity for the sheet feeding retry may be determined based on whether the difference between the jam detection positional information on the leading end of the sheet and the positional information on the leading end of the sheet is greater than a first threshold. Instead of or together with the above method, the existence or non-existence of the generation of the sheet feeding jam may be determined based on whether the difference between the jam detection positional information on the leading end of the sheet and the positional information on the leading end of the sheet is greater than a second threshold. In this case, preferably the second threshold is greater than the first threshold.

Figure 15:
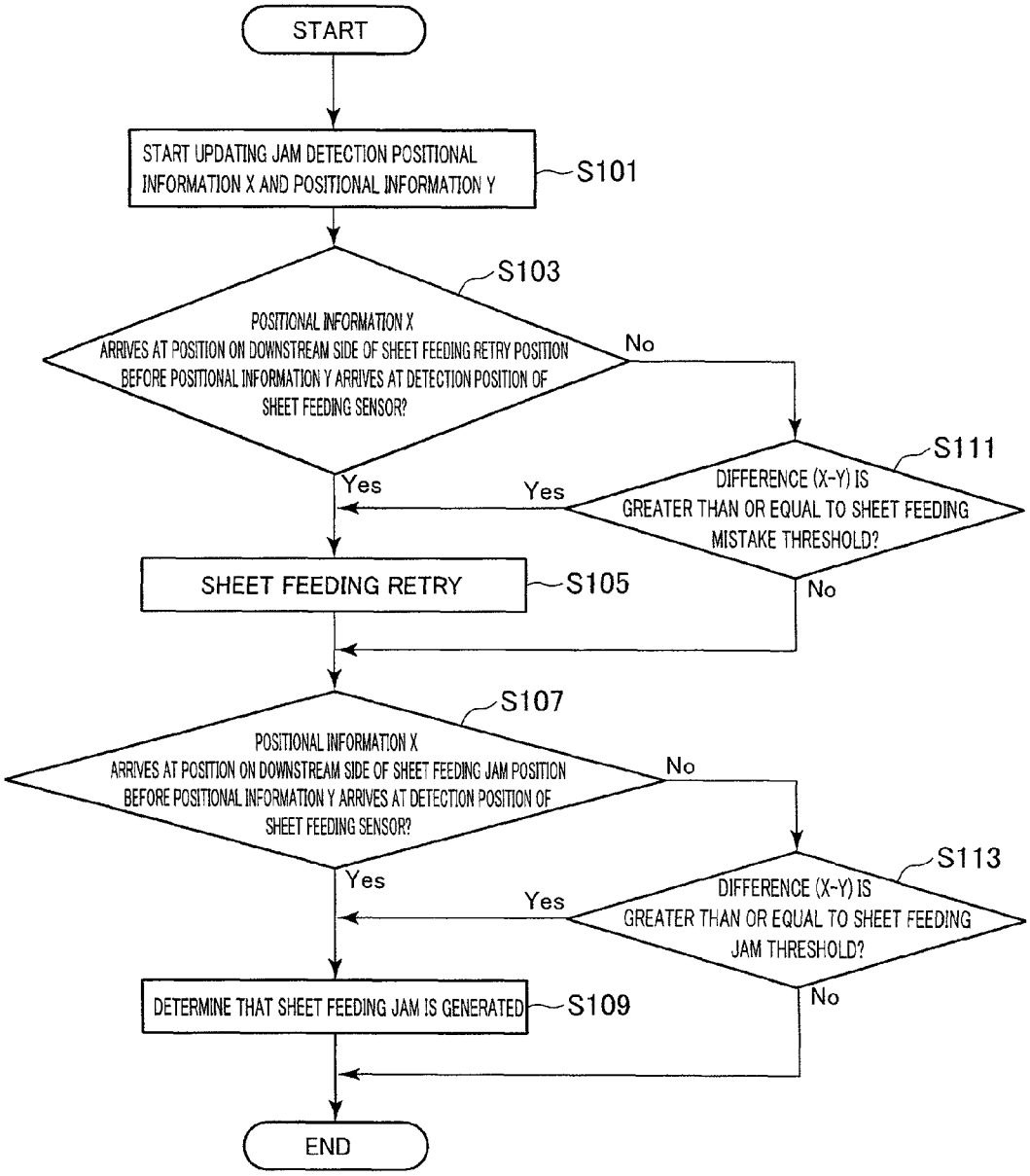
FIG. 15 is a flowchart illustrating control of the determination whether the sheet feeding retry is required and whether the sheet feeding jam is generated.

FIG. 15 is a flowchart illustrating control of the determination whether the sheet feeding retry is required and the determination whether the sheet feeding jam is generated. For example, the flowchart in FIG. 15 is performed such that CPU51 loads the control program stored in ROM58.

Referring to FIG. 15, when the sheet feeding roller starts the sheet feeding, jam detection positional information updating unit 63 and sheet positional information updating unit 62 respectively add the sheet feed amount of the sheet feeding roller to start updating jam detection positional information X on the leading end of the sheet and positional information Y on the leading end of the sheet respectively (S101). CPU51 determines whether positional information X arrives at the position on the downstream side of the sheet feeding retry position before positional information Y arrives at the detection position of the sheet feeding sensor (S103).

In step S103, when positional information X arrives at the position on the downstream side of the sheet feeding retry position (Yes in S103), sheet conveying unit 10 performs the sheet feeding retry (S105). Then CPU51 goes to processing in step S107. On the other hand, in step S103, when positional information X does not arrive at the position on the downstream side of the sheet feeding retry position (No in S103), CPU51 determines whether a difference (X−Y) between the positional information X and positional information Y is greater than or equal to a sheet feeding mistake threshold S111).

In step S111, when the difference (X−Y) is greater than or equal to the sheet feeding mistake threshold (Yes in S111), sheet conveying unit 10 goes to the processing in step S105. On the other hand, in step S111, when the difference (X−Y) is less than the sheet feeding mistake threshold (No in S111), CPU51 goes to the processing in step S107.

In step S107, CPU51 determines whether positional information X arrives at the position on the downstream side of the sheet feeding jam position before positional information Y arrives at the detection position of the sheet feeding sensor (S107).

In step S107, when positional information X arrives at the position on the downstream side of the sheet feeding jam position (Yes in S107), CPU51 determines that the sheet feeding jam is generated (S109), and ends the processing. On the other hand, in step S107, when positional information X does not arrive at the position on the downstream side of the sheet feeding jam position (No in S107), CPU51 determines whether the difference (X−Y) between positional information X and positional information Y is greater than or equal to a sheet feeding jam threshold (S113).

In step S113, when the difference (X−Y) is greater than or equal to the sheet feeding jam threshold (Yes in S113), CPU51 determines that the sheet feeding jam is generated (S109), and ends the processing. On the other hand, in step S113, when the difference (X−Y) is less than the sheet feeding jam threshold (No in S113), CPU51 stops the sheet feeding, and ends the processing.

Because the configuration and other pieces of processing of the image forming apparatus of the fourth embodiment are identical to those of the first embodiment, the description is not repeated here.

According to the fourth embodiment, the necessity for the sheet feeding retry and the existence or non-existence of the generation of the sheet feeding jam are determined based on the positional information on the sheet and the jam detection positional information on the sheet will be described in a fourth embodiment.

Fifth Embodiment

The sheet positional information updating method performed by sheet positional information updating unit 62 in the case of generation of multi feeding will be described in a fifth embodiment.

In the case that sheet conveying unit 10 sequentially conveys a plurality of sheets, sheet conveying unit 10 stops the sheet feeding roller after a sheet SH1 that is the preceding sheet is fed by driving the sheet feeding roller for a given time. After a given time elapses since the sheet feeding roller is stopped, sheet conveying unit 10 drives the sheet feeding roller again to feed a sheet SH2 that is the subsequent sheet. In this case, sheet positional information updating unit 62 drives the sheet feeding roller again, and updates the positional information on the leading end of sheet SH2 by adding the sheet feed amount of the sheet feeding roller.

Figure 16:
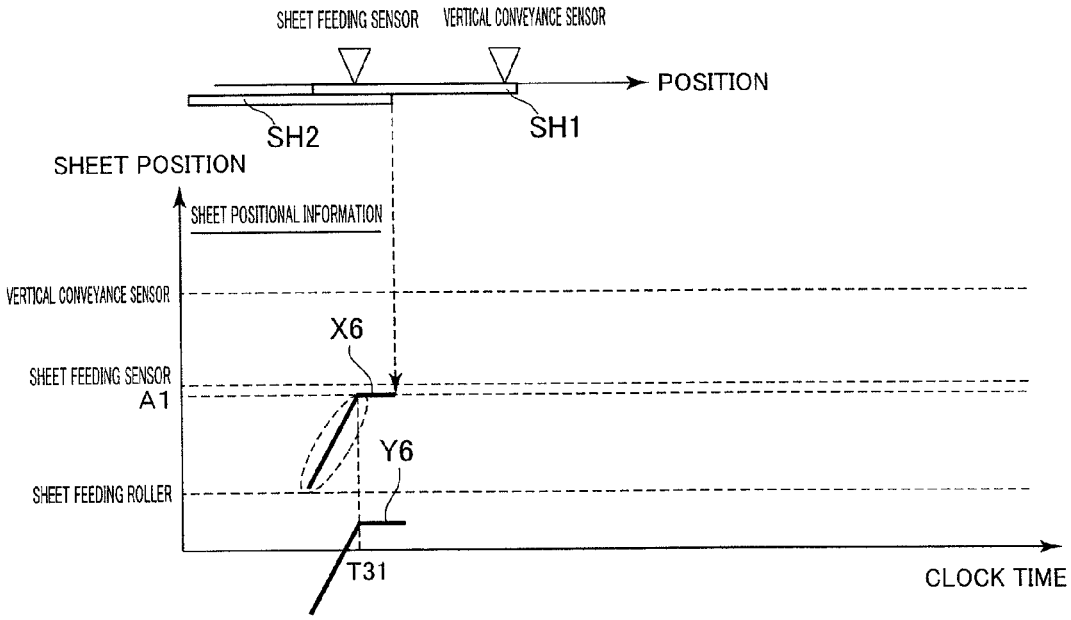
FIG. 16 is a first drawing schematically illustrating clock time changes of a leading end and a tailing end of a sheet SH2 when multi feeding of the sheet is generated.

FIG. 16 is a first drawing schematically illustrating clock time changes of the leading end and the tailing end of sheet SH2 when the multi feeding of the sheet is generated. In FIG. 16, a vertical axis indicates the sheet position, and a horizontal axis indicates time. A line X6 indicates the positional information on the leading end of sheet SH2, and a line Y6 indicates the positional information on the tailing end of sheet SH2.

Referring to FIG. 16, the sheet feeding sensor is provided on the downstream side of the sheet feeding roller, and a vertical conveyance sensor is provided on the downstream side of the sheet feeding sensor. In the case of the multi feeding of the sheet is generated, because the leading end of sheet SH2 is hidden behind sheet SH1, the sheet feeding sensor cannot detect the leading end of sheet SH2. Therefore, at a clock time T31, the sheet feeding sensor does not detect the leading end of sheet SH2 even if the positional information on the leading end of sheet SH2 arrives at position A1 on the slightly upstream side of the detection position of the sheet feeding sensor. Sheet positional information updating unit 62 stops the update of the positional information on the leading end of sheet SH2 in position A1, and maintains the positional information on the leading end of sheet SH2 in position A1. Sheet positional information updating unit 62 also stops the update of the positional information on the tailing end of sheet SH2.

Figure 17:
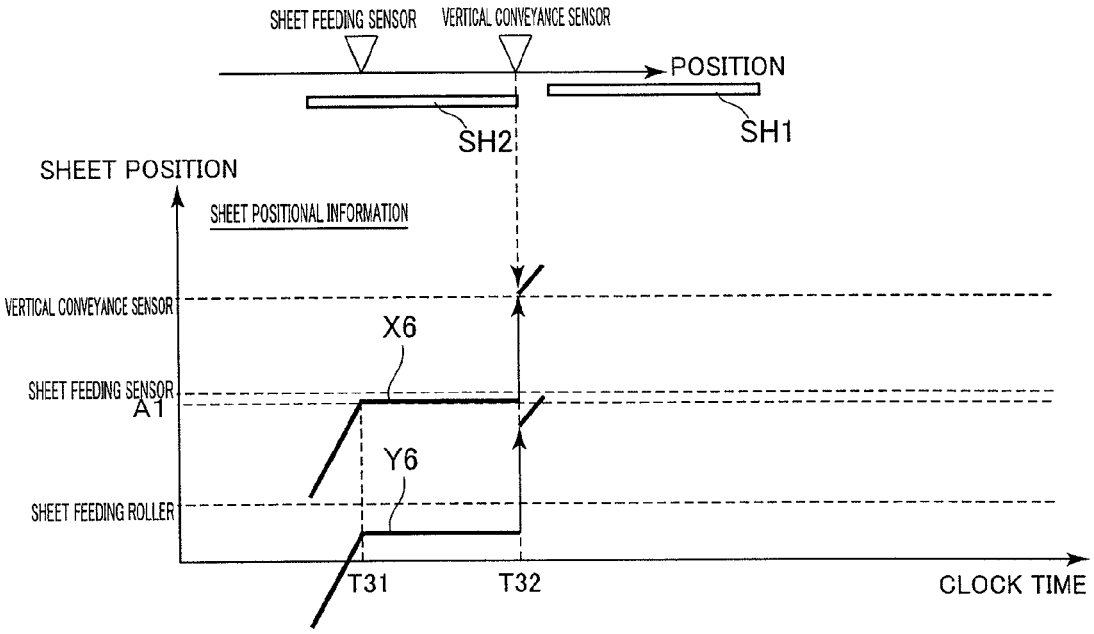
FIG. 17 is a second drawing schematically illustrating clock time changes of the leading end and the tailing end of the sheet SH2 when the multi feeding of the sheet is dissolved.

FIG. 17 is a second drawing schematically illustrating clock time changes of the leading end and the tailing end of sheet SH2 when the multi feeding of the sheet is generated.

Referring to FIG. 17, in the case that the multi feeding is eliminated between the sheet feeding sensor and the vertically conveyance sensor, because the leading end of sheet SH2 is separated from the tailing end of sheet SH1, at a clock time T32, the vertically conveyance sensor detects the leading end of sheet SH2 although the sheet feeding sensor does not detect the leading end of sheet SH2. In the case that the downstream-side vertically conveyance sensor detects the leading end of sheet SH2 although the upstream-side sheet feeding sensor does not detect the leading end of sheet SH2, sheet positional information updating unit 62 changes (corrects) the positional information on the leading end of sheet SH2 from position A1 to the detection position of the vertically conveyance sensor. Then sheet positional information updating unit 62 resumes the updates of the pieces of positional information on the leading end and the tailing end of sheet SH2 with position A1 as the starting point.

Because the configuration and other pieces of processing of the image forming apparatus of the fifth embodiment are identical to those of the first embodiment, the description is not repeated here.

According to the fifth embodiment, even if the sheet feeding sensor cannot detect the on-edge position of the subsequent sheet due to the generation of the multi feeding, the sheet feeding conveyance control can be continued without any difficulty when the multi feeding is eliminated later. It is not necessary to specially change the setting of the sheet feeding sequence module or the vertically conveying sequence module.

According to the above embodiments, the sheet conveying device that promotes the commonality of the sequence module in a plurality of models can be provided. According to the present invention, the sheet conveying device in which the device configuration is simplified can be provided.

[Others]

The above embodiments can properly be combined. For example, in the case that method for updating the positional information on the tailing end of the sheet in FIG. 12 is performed by a combination of the second and third embodiments, a relationship between the off-edge detection starting position and the on-edge detection starting position of the sensor may be set as illustrated in FIG. 13.

The pieces of processing in the above embodiments may be performed by software or a hardware circuit. A program executing the pieces of processing in the above embodiments may be provided, and the program may be provided to the user while recorded in recording mediums, such as a CD-ROM, a flexible disk, a hard disk, a ROM, a RAM, and a memory card. The program is executed by computers, such as the CPU. The program may be down-loaded to the apparatus through communication lines, such as the Internet.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet conveying device comprising:

a first conveying roller for conveying a sheet;

a second conveying roller for conveying said sheet on a downstream side of said first conveying roller;

a detection sensor for detecting a leading end of said sheet in a leading-end detection position on the downstream side of said second conveying roller;

a first leading-end position output unit for outputting first positional information on the leading end of the sheet; and a controller for controlling drive states of said first and second conveying rollers respectively, based on not a detection state of said detection sensor but the first positional information on the leading end of said sheet, which is outputted from said first leading-end position output unit, wherein said first leading-end position output unit is configured to:

update the first positional information on the leading end of said sheet by adding a feed amount of said sheet conveyed by said first conveying roller;

stop the update of the first positional information on the leading end of said sheet when said detection sensor does not detect the leading end of said sheet, and the first positional information on the leading end of said sheet as updated by adding the feed amount indicates that the leading end of said sheet arrives at a position on an upstream side of said leading-end detection position; and resume the update of the first positional information on the leading end of said sheet with said leading-end detection position as a starting point when said detection sensor detects the leading end of said sheet after the update of the first positional information on the leading end of said sheet has stopped.

2. The sheet conveying device according to claim 1, further comprising a second leading-end position output unit for outputting second positional information on the leading end of the sheet, wherein said second leading-end position output unit is configured to:

update the second positional information on the leading end of the sheet by adding the feed amount of said sheet conveyed by said first conveying roller; and correct the second positional information on the leading end of the sheet to said leading-end detection position in the case that said detection sensor detects the leading end of said sheet, and said controller controls drive states of said first and said second conveying rollers further based on the second positional information on the leading end of the sheet, which is output from said second leading-end position output unit.

3. The sheet conveying device according to claim 2, further comprising a jam detector for detecting generation of a jam based on a difference between the second positional information on the leading end of the sheet, which is output from said second leading-end position output unit, and the first positional information on the leading end of the sheet, which is output from said first leading-end position output unit.

4. The sheet conveying device according to claim 2, wherein said controller resumes sheet feeding of said first conveying roller after tentatively stopping the sheet feeding in at least one of the cases: where the second positional information on the leading end of the sheet, which is output from said second leading-end position output unit, arrives at a first position although the first positional information on the leading end of the sheet, which is output from said first leading-end position output unit, does not arrive at the leading-end detection position; and where a difference between the second positional information on the leading end of the sheet, which is output from said second leading-end position output unit, and the first positional information on the leading end of the sheet, which is output from said first leading-end position output unit, is greater than a first threshold.

5. The sheet conveying device according to claim 4, wherein said second positional information output unit is further configured to:

correct the second positional information on the leading end of the sheet to a sheet feeding starting position in the case said controller resumes the sheet feeding.

6. The sheet conveying device according to claim 2, wherein said controller determines that a jam is generated in at least one of the cases: where the second positional information on the leading end of the sheet, which is output from said second leading-end position output unit, arrives at a second position although the first positional information on the leading end of the sheet, which is output from said first leading-end position output unit, does not arrive at said leading-end detection position; and where a difference between the second positional information on the leading end of the sheet, which is output from said second leading-end position output unit, and the first positional information on the leading end of the sheet, which is output from said first leading-end position output unit, is greater than a second threshold.

7. The sheet conveying device according to claim 1, further comprising a tailing-end position output unit for outputting positional information on a tailing end of the sheet by subtracting a length in a feed direction of said sheet from the first positional information on the leading end of the sheet, which is output from said first leading-end position output unit.

8. The sheet conveying device according to claim 7, wherein said detection sensor further detects the tailing end of said sheet in a tailing-end detection position on the downstream side of said second conveying roller, and said tailing-end position output unit is configured to:

update the positional information on the tailing end of the sheet by subtracting the length in the feed direction of said sheet from the first positional information on the leading end of the sheet, which is output from said first leading-end position output unit;

stop the update of the positional information on the tailing end of the sheet when said detection sensor does not detect the tailing end of said sheet, and the positional information on the tailing end of the sheet as updated by subtracting the length of the sheet in the feed direction from the first positional information indicates that the tailing end of the sheet arrives at a position on an upstream side of said tailing-end detection position; and resume the update of the positional information on the tailing end of the sheet of with the tailing-end detection position as a starting point in the case that said detection sensor detects the tailing end of said sheet after the update of the positional information on the tailing end of the sheet has stopped.

9. The sheet conveying device according to claim 8, wherein said detection sensor detects the leading end of said sheet in a first range in a sheet passage route of said sheet and detects the tailing end of said sheet in a second range in the sheet passage route of said sheet, and an off-edge detection starting position that is a position on a most upstream side of the sheet passage route in said second range is located on an upstream side of an on-edge detection starting position that is of a position on a most upstream side of the sheet passage route in said first range.

10. The sheet conveying device according to claim 7, further comprising a size error detector for detecting a size error that is an error in the case that said sheet is not a standard size, wherein said size error detector detects the size error based on a difference between the first positional information on the leading end of the sheet, which is output from said first leading-end position output unit, and the positional information on the tailing end of the sheet, which is output from said tailing-end position output unit.

11. The sheet conveying device according to claim 1, further comprising another detection sensor for detecting the leading end of said sheet in a downstream-side detection position on a downstream side of said leading-end detection position, wherein said first leading-end position output unit is further configured to:

resume the update of the first positional information on the leading end of said sheet with said downstream-side detection position as a starting point when said another detection sensor detects the leading end of said sheet, and said detection sensor does not detect the leading end of said sheet.

12. A method for controlling a sheet conveying device including:

a first conveying roller for conveying a sheet, a second conveying roller for conveying said sheet on a downstream side of said first conveying roller, and a detection sensor for detecting a leading end of said sheet in a leading-end detection position on the downstream side of said second conveying roller, the method comprising:

a first leading-end position output step of outputting positional information on the leading end of the sheet; and a controlling step of controlling drive states of said first and second conveying rollers respectively, based on not a detection state of said detection sensor but the positional information on the leading end of the sheet, which is outputted in said first leading-end position outputting step, wherein said first leading-end position outputting step includes:

a first leading-end updating step of updating the positional information on the leading end of the sheet by adding a feed amount of said sheet conveyed by said first conveying roller;

a leading-end position update stopping step of stopping the update of the positional information on the leading end of the sheet, which is performed in said first leading-end position updating step, when said detection sensor does not detect the leading end of said sheet in the case that the positional information updated in said first leading-end position updating step arrives at a position on an upstream side of said leading-end detection position; and a first leading-end position update resuming step of resuming the update of the positional information on the leading end of the sheet, which is performed in said first leading-end position updating step, with said leading-end detection position as a starting point in the case that said detection sensor detects the leading end of the sheet after the update is stopped in said leading-end position update stopping step.

13. A non-transitory computer-readable recording medium storing a control program for a sheet conveying device, said sheet conveying device including:

a first conveying roller for conveying a sheet;

a second conveying roller for conveying said sheet on a downstream side of said first conveying roller; and a detection sensor for detecting a leading end of said sheet in a leading-end detection position on the downstream side of said second conveying roller, said control program causing a computer to execute processing comprising:

a first leading-end position output step of outputting positional information on the leading end of the sheet; and a controlling step of controlling drive states of said first and second conveying rollers respectively, based on not a detection state of said detection sensor but the positional information on the leading end of the sheet, which is outputted in said first leading-end position outputting step, and said first leading-end position outputting step includes:

a first leading-end updating step of updating the positional information on the leading end of the sheet by adding a feed amount of said sheet conveyed by said first conveying roller;

a leading-end position update stopping step of stopping the update of the positional information on the leading end of the sheet, which is performed in said first leading-end position updating step, when said detection sensor does not detect the leading end of said sheet in the case that the positional information updated in said first leading-end position updating step arrives at a position on an upstream side of said leading-end detection position; and a first leading-end position update resuming step of resuming the update of the positional information on the leading end of the sheet, which is performed in said first leading-end position updating step, with said leading-end detection position as a starting point in the case that said detection sensor detects the leading end of said sheet after the update is stopped in said leading-end position update stopping step.

* * * * *